US007393626B2

(12) United States Patent
Yamamoto

(10) Patent No.: US 7,393,626 B2
(45) **Date of Patent: *Jul. 1, 2008**

(54) PHOTOTHERMOGRAPHIC MATERIAL AND METHOD FOR PRODUCING SILVER HALIDE USED FOR IT

(75) Inventor: Seiichi Yamamoto, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/614,095

(22) Filed: Jul. 8, 2003

(65) Prior Publication Data

US 2004/0023175 A1 Feb. 5, 2004

(30) Foreign Application Priority Data

Jul. 23, 2002 (JP) ..... 2002-214210

(51) Int. Cl.
*G03C 1/498* (2006.01)
*G03C 1/08* (2006.01)

(52) U.S. Cl. ..... 430/619; 430/603; 430/604; 430/605

(58) Field of Classification Search ..... 430/619, 430/567, 604, 603, 605, 569
See application file for complete search history.

(56) References Cited

U.S. PATENT DOCUMENTS

| | | | | | |
|---|---|---|---|---|---|
| 4,332,889 | A | | 6/1982 | Siga et al. | |
| 4,552,838 | A | * | 11/1985 | Wey et al. | 430/569 |
| 4,581,327 | A | * | 4/1986 | Habu et al. | 430/567 |
| 5,492,803 | A | | 2/1996 | Landgrebe et al. | |
| 5,686,228 | A | | 11/1997 | Murray et al. | |
| 5,716,775 | A | * | 2/1998 | Uehara et al. | 430/611 |
| 5,747,236 | A | * | 5/1998 | Farid et al. | 430/583 |
| 5,958,668 | A | | 9/1999 | Matsumoto et al. | |
| 5,998,126 | A | | 12/1999 | Toya et al. | |
| 6,060,231 | A | * | 5/2000 | Zou | 430/619 |
| 6,090,538 | A | | 7/2000 | Arai et al. | |
| 6,110,659 | A | * | 8/2000 | Hatakeyama et al. | 430/617 |
| 6,120,983 | A | * | 9/2000 | Okada et al. | 430/619 |
| 6,143,488 | A | | 11/2000 | Uytterhoeven et al. | |
| 6,156,491 | A | | 12/2000 | Goto | |
| 6,171,767 | B1 | | 1/2001 | Kong et al. | |
| 6,174,663 | B1 | | 1/2001 | Kato | |
| 6,265,146 | B1 | | 7/2001 | Kashiwagi | |
| 6,274,297 | B1 | | 8/2001 | Uytterhoeven et al. | |
| 6,376,167 | B1 | | 4/2002 | Ito | |
| 6,413,712 | B1 | | 7/2002 | Yoshioka et al. | |
| 6,482,583 | B1 | * | 11/2002 | Ikari | 430/619 |
| 6,645,714 | B2 | | 11/2003 | Oya et al. | |
| 6,689,554 | B2 | | 2/2004 | Yamada et al. | |
| 6,855,488 | B2 | | 2/2005 | Yamada et al. | |
| 2001/0041313 | A1 | | 11/2001 | Takiguchi | |
| 2002/0028414 | A1 | * | 3/2002 | Yanagisawa et al. | 430/601 |
| 2003/0224307 | A1 | | 12/2003 | Yamamoto et al. | |
| 2004/0005522 | A1 | * | 1/2004 | Oka et al. | 430/540 |

FOREIGN PATENT DOCUMENTS

| | | | |
|---|---|---|---|
| EP | 0922995 | | 6/1999 |
| EP | 1096310 | A2 * | 5/2001 |
| JP | A 8-297345 | | 11/1996 |
| JP | A 09-090550 | | 4/1997 |
| JP | 2000-066325 | * | 3/2000 |
| JP | A 2000-66325 | | 3/2000 |
| JP | A 2001-100356 | | 4/2001 |
| JP | A 2001-147503 | | 5/2001 |

* cited by examiner

*Primary Examiner*—Thorl Chea
(74) *Attorney, Agent, or Firm*—Margaret A. Burke; Sheldon J. Moss

(57) ABSTRACT

The invention provides a photothermographic material including, on a same surface of a substrate, photosensitive silver halide grains, a non-photosensitive organic silver salt, a reducing agent and a binder, in which the photosensitive silver halide grains include iridium and a metal of groups 3 to 10 of the periodic table other than iridium, and 90% or more of the total iridium amount within the grain are contained in a core of 50% or less of the grain.

9 Claims, No Drawings

PHOTOTHERMOGRAPHIC MATERIAL AND METHOD FOR PRODUCING SILVER HALIDE USED FOR IT

CROSS-REFERENCE TO RELATED APPLICATION

This application claims priority under 35USC 119 from Japanese Patent Application No. 2002-214210, the disclosure of which is incorporated by reference herein.

BACKGROUND OF THE INVENTION

1. Field of the Invention

The present invention relates to a photothermographic material and a method for producing silver halide to be employed therein.

2. Description of the Related Art

In recent years, it is strongly desired in the medical field to reduce the amount of waste processing liquids in view of environmental preservation and space saving. For this reason, there is desired a technology for a photothermographic material for medical diagnosis and for photographic applications, capable of efficient exposure with a laser image setter or a laser imager and of forming a sharp black image with a high resolution and a high sharpness. Such photosensitive thermal-development photographic material can eliminate use of processing chemicals in solutions and can provide users with a thermal development system which is simpler and does not contaminate the environment.

An image for medical use requires a particularly high image quality excellent in sharpness and graininess because a delicate image presentation is required. Also there is preferred an image of cold black tone in consideration of ease of diagnosis. Currently various hard copy systems utilizing pigments or dyes, such as an ink jet system and an electrophotographic system, are available as ordinary image forming systems, but no such system yet is satisfactory as an output system for the image for medical use.

On the other hand, a thermal image forming system utilizing an organic silver salt is disclosed in U.S. Pat. Nos. 3,152,904 and 3,457,075 and in "Thermally Processed Silver Systems", B. Shely, Imaging Processes and Materials, Neblette 8th edition, edited by Sturge, V. Walworth and A. Shepp, p.2 (1996). More specifically, a photothermographic material has a photosensitive layer in which a catalytic active amount of a photocatalyst (for example silver halide), a reducing agent, a reducible silver salt (for example organic silver salt) and a toning agent for regulating the color of silver if necessary, are generally dispersed in a matrix binder. The photothermographic material is heated, after an exposure to an image, to a high temperature (for example 80° C. or higher) whereby a black silver image is formed by a redox reaction between the silver halide or reducible silver salt (acting as an oxidizing agent) and the reducing agent. The redox reaction is accelerated by a catalytic effect of a latent image in silver halide, generated by the exposure to light. Therefore, the black silver image is formed in an exposed area. Such system is described in various references including U.S. Pat. No. 2,910,377 and Japanese Patent Publication (JP-B) No. 43-4924, and a Fuji Medical Dry Imager FM-DPL has been commercialized as a medical image forming system utilizing a photothermographic material.

In the image forming system utilizing such organic silver salt, since the photosensitive silver halide or the reducing agent remains even after the development process because of the absence of a fixing step, an image preservability, particularly a gradual blacking of an unblackened area when exposed for example to an indoor light for a prolonged period (such phenomenon being called "print-out" in the present invention) has been a major issue. For alleviating such print-out, there has been proposed to use a halogen precursor compound or another development terminating agent, but such compound also has a drawback of inhibiting the image formation itself and cannot therefore be sufficiently effective. Also U.S. Pat. No. 6,143,488 and EP 0922995 disclose a method of utilizing AgI formed by converting the organic silver salt. However, such method cannot provide a sufficient sensitivity, and it is difficult to formulate a practically acceptable system. Also photosensitive materials utilizing AgI are disclosed in WO 97-48014 and 97-48015, U.S. Pat. No. 6,165,705, Japanese Patent Application Laid-Open (JP-A) No. 8-297345, Japanese Patent No. 2785129 etc., but none of these has attained a sufficient sensitivity and a sufficient fog level and has been practically usable.

In a photosensitive silver halide emulsion employed in a photothermographic material, it is well known a heavy metal doping can increase the sensitivity. For example JP-A No. 2001-42471 describes a doping of a transition metal of groups 6 to 10 of the periodic table in silver halide grains. It is also described that such doped metal is preferably distributed either at higher content at the surface or in the vicinity thereof of the grain than in the interior thereof, or uniformly throughout the grain, thereby contributing to an increase of the sensitivity.

JP-A No. 2001-042473 discloses a photosensitive silver halide emulsion having a high content phase of an iridium metal complex at a surface phase of silver halide grains. As an effect, there is obtained a high sensitivity.

Such heavy metal doping methods describe a heavy metal doping on the surface of silver halide grains, thereby obtaining a high sensitivity under an exposure with a high illumination intensity. However there has not been mentioned the issue of print-out which is specific to a photothermographic material, and it is estimated that the influence of the distribution of the doped heavy metal within the grain has not been recognized at all.

On the other hand, JP-A No. 2000-66325 discloses a method of doping an iridium-based dopant and a dopant based on a transition metal other than iridium in different areas of a silver halide grain respectively, and describes an effect of obtaining a higher sensitivity, particularly a sensitivity under an exposure of a high illumination intensity. There is described that the iridium-based dopant is doped in an area of 50 to 55% from the center of the silver halide grain, in an amount of $6\times10^{-6}$ mol/mol.Ag, while the metal other than iridium is doped in an area of 65 to 70% from the center, in an amount of $4\times10^{-5}$ mol/mol.Ag. It is also described that such method is applicable to a multi-color photosensitive material having two or more silver halide emulsion layers but a photothermographic material has not been mentioned. Consequently, it is considered that the issue of print-out, which is specific to the photothermographic material, has never been recognized.

SUMMARY OF THE INVENTION

In consideration of the foregoing, an object of the present invention is to provide a photothermographic material having a high sensitivity, a high image density, and a satisfactory print-out property. Another object is to provide a method for producing photosensitive silver halide to be employed in the photothermographic material.

Such objects can be attained by a photothermographic material and a producing method shown in the following.

The first aspect of the invention provides a photothermographic material (X) comprising, on one surface of a substrate, photosensitive silver halide grains, a non-photosensitive organic silver salt, a reducing agent and a binder, wherein said photosensitive silver halide grains include iridium and a metal of groups 3 to 10 of the periodic table other than iridium, and 90% or more of a total iridium amount within the grain is contained in a core of 50% or less of the grain.

The second aspect of the invention provides a photothermographic material (X), wherein said metal of groups 3 to 10 of the periodic table other than iridium is selected from the group consisting of ruthenium, iron, osmium, copper, cobalt, platinum, zinc and rhodium.

The third aspect of the invention provides a photothermographic material (X), wherein said metal of groups 3 to 10 of the periodic table other than iridium is iron or ruthenium.

The fourth aspect of the invention provides a photothermographic material (X), wherein said photosensitive silver halide grains have an average particle size of 10 to 50 nm.

The fifth aspect of the invention provides a photothermographic material (X), wherein an amount of iridium in the silver halide grains is from $1\times10^{-8}$ to $1\times10^{-2}$ mol per 1 mol of silver halide.

The sixth aspect of the invention provides a photothermographic material (X), wherein an amount of the metal of groups 3 to 10 of the periodic table other than iridium in the silver halide grains is from $1\times10^{-8}$ to $1\times10^{2}$ mol per 1 mole of silver halide.

The seventh aspect of the invention provides a photothermographic material (X), wherein the photosensitive silver halide grains are chemically sensitized by one of a sulfur sensitizing method, a selenium sensitizing method, and a tellurium sensitizing method.

The eighth aspect of the invention provides a photothermographic material (X), wherein the photosensitive silver halide grains are gold sensitized.

The ninth aspect of the invention provides a photothermographic material (X), wherein the photosensitive silver halide grains are reduction sensitized.

The tenth aspect of the invention provides a photothermographic material (X), further comprising a fragmentable electron donating sensitizer (FED sensitizer).

The eleventh aspect of the invention provides a photothermographic material (X), wherein said photosensitive silver halide grains have a core/shell structure.

The twelfth aspect of the invention provides a photothermographic material (X), wherein the photosensitive silver halide grains have a core/shell structure of two to five layers.

The thirteenth aspect of the invention provides a method (Y) of producing photosensitive silver halide grains to be employed in a photothermographic material including, on a same surface of a substrate, photosensitive silver halide grains, a non-photosensitive organic silver salt, a reducing agent and a binder, wherein the photosensitive silver halide grains include iridium and a metal of groups 3 to 10 of the periodic table other than iridium, and 90% or more of a total iridium amount is added by the time that an added amount of silver nitrate reaches 30% of a total amount of silver nitrate.

The fourteenth aspect of the invention provides a method (Y) of producing photosensitive silver halide grains, wherein said metal of groups 3 to 10 of the periodic table other than iridium is selected from the group consisting of ruthenium, iron, osmium, and rhodium.

The fifteenth aspect of the invention provides a method (Y) of producing photosensitive silver halide grains, wherein said photosensitive silver halide grains have an average particle size of 10 to 50 nm.

The sixteenth aspect of the invention provides a method (Y) of producing photosensitive silver halide grains, wherein a compound of the iridium and a solution thereof are directly added to a reaction vessel for silver halide.

The seventeenth aspect of the invention provides a method (Y) of producing photosensitive silver halide grains, wherein a compound of the metal other than iridium and a solution thereof are directly added to a reaction vessel for silver halide.

The eighteenth aspect of the invention provides a method (Y) for producing photosensitive silver halide grains, wherein the photosensitive silver halide grains have a core/shell structure.

The nineteenth aspect of the invention provides a method (Y) for producing photosensitive silver halide grains, wherein the photosensitive silver halide grains have a core/shell structure, a core portion and a shell portion of the photosensitive silver halide grain are prepared from separate halogen solutions, and a compound of the iridium is added in advance to a halogen solution to be used for forming the core portion.

The twentieth aspect of the invention provides a method (Y) for producing photosensitive silver halide grains, wherein the photosensitive silver halide grains have a core/shell structure, a core portion and a shell portion of the photosensitive silver halide grain are prepared from separate halogen solutions, and the metal of groups 3 to 10 of the periodic table other than iridium is added in advance to a halogen solution to be used for forming the shell portion.

DETAILED DESCRIPTION OF THE INVENTION

In the following, the present invention will be explained in detail.

The photothermographic material of the present invention has, on at least one surface of a substrate, an image forming layer including a photosensitive silver halide, a non-photosensitive organic silver salt, a reducing agent and a binder. Also there may be provided a surface protective layer on the image forming layer, or a back layer or a back surface protective layer on the opposite surface.

Each of the image forming layer, the surface protective layer, the back layer and the back surface protective layer may be constituted by a single layer or plural layers.

In the following there will be given a detailed explanation on the configuration of these layers and preferred components thereof.

1. IMAGE FORMING LAYER

1-1. Photosensitive Silver Halide

1) Silver Halide Composition

A halogen composition of the photosensitive silver halide to be employed in the present invention is not particularly limited, and can be silver chloride, silver chlorobromide, silver bromide, silver iodobromide, silver iodochlorobromide or silver iodide, among which preferred are silver bromide and silver iodide. A halogen composition within the grain may be uniform, or show a stepwise change or a continuous change. There may also be preferably employed a silver halide grain having a core/shell structure. There is preferred a core/shell grain with a 2- to 5-layered structure, more preferably 2- to 4-layered structure. There can also be advantageously employed a method of localizing silver bromide or silver iodide on a surface of grains of silver chloride, silver bromide or silver chlorobromide.

2) Grain Forming Method

A method for forming photosensitive silver halide is well known in the art, and there can be utilized, for example, methods described in Research Disclosure 17029, June 1978 and U.S. Pat. No. 3,700,458. More specifically, there is employed a method of adding a silver supplying compound and a halogen supplying compound to a solution of gelatin or another polymer thereby preparing a photosensitive silver halide, and thereafter mixing the photosensitive silver halide with an organic silver salt. There are also preferably employed a method described in JP-A No. 11-119374, paragraphs 0217 to 0224, and a method described in JP-A Nos. 11-352627 and 2000-347335.

3) Grain Size

A grain size of the photosensitive silver halide is preferably made smaller in order to suppress a turbidity after image formation, and is specifically 0.20 μm or less, more preferably from 0.01 to 0.06 μm and further preferably 0.02 to 0.04 μm. In the invention, the grain size means a diameter of a circle having the same area with a projected area of the grain (a projected area of a principal plane in the case of a flat plate-shaped grain).

4) Grain Shape

Silver halide grains can assume a cubic shape, an octahedral shape, a flat plate shape, a spherical shape, a rod shape, a potato-like shape etc., but cubic grains are particularly preferred in the invention. There can also be advantageously employed grains of which corners are rounded. The plane index (Miller's index) of an external surface of the photosensitive silver halide grains are not particularly restricted, but it is preferred that a [100] plane, showing a high spectral sensitization efficiency when adsorbing a spectral sensitizing dye, has a high proportion. Such proportion is preferably 50% or higher, more preferably 65% or higher and further preferably 80% or higher. A proportion of the Miller index [100] plane can be determined by a method described in T. Tani; J. Imaging Sci., 29, 165 (1985), utilizing adsorption dependences of [111] and [100] planes in adsorbing a sensitizing dye.

5) Heavy Metal

The photosensitive silver halide of the invention includes iridium as a first doping metal, and, as a second doping metal, a metal of groups 3 to 10 of the periodic table, other than iridium.

5-1) Iridium

Iridium can be doped either by adding a metal complex, having iridium as a central metal, in a suitable stage of silver halide grain formation thereby causing introduction into the silver halide crystal, or by mixing fine particles doped with iridium in an interim stage of silver halide grain formation or after the grain formation thereby causing a transfer of iridium ions from the fine particles to the silver halide crystals.

A metal complex having iridium as a central metal is a trivalent or tetravalent iridium complex which can be, for example, hexachloroiridium(III) complex salt, hexachloroiridium(IV) complex salt, hexabromoiridium(III) complex salt, hexabromoiridium(IV) complex salt, hexaiodoiridium(III) complex salt, hexaiodoiridium(IV) complex salt, aquapentachloroiridium(III) complex salt, aquapentachloroiridium (IV) complex salt, aquapentabromoiridium(III) complex salt, aquapentabromoiridium(IV) complex salt, aquapentaiodoiridium(III) complex salt, aquapentaiodoiridium(IV) complex salt, diaquatetrachloroiridium(III) complex salt, diaquatetrachloroiridium(IV) complex salt, diaquatetrabromoiridium (III) complex salt, diaquatetrabromoiridium(IV) complex salt, diaquatetraiodoiridium(III) complex salt, diaquatetraiodoiridium(IV) complex salt, triaquatrichloroiridium(III) complex salt, triaquatrichloroiridium(IV) complex salt, triaquatribromoiridium(III) complex salt, triaquatribromoiridium(IV) complex salt, triaquatriiodoiridium(III) complex salt, triaquatriiodoiridium(IV) complex salt, hexaammineiridium(III) complex salt, or hexaammineiridium(IV) complex salt, but these examples are not restrictive.

In the invention, 90% or more of the total iridium amount are included in a core of 50% of a silver halide grain. In the invention, "a core of 50%" means a core portion corresponding to 50% of total mol of silver halide in the grain.

Preferably, 90% or more of the total iridium are included in a core of 40%, more preferably in a core of 30%.

Iridium can be doped into the core portion either by a direct addition into a reaction vessel prior to formation of silver halide grains or by an addition into the reaction vessel prior to the completion of grain formation. There may also be adopted a method in which two or more halogen solutions are prepared for respectively forming a core portion and a shell portion of silver halide, and an iridium compound is added in advance to the halogen solution for forming the core portion and is added together with the halogen solution to the reaction vessel.

A doping amount of iridium is preferably $1\times10^{-8}$ to $1\times10^{-2}$ mol per 1 mol of silver halide, more preferably $1\times10^{-6}$ to $1\times10^{-2}$ mol and further preferably $1\times10^{-5}$ to $1\times10^{-3}$ mol.

5-2) Metal of Groups 3 to 10 of Periodic Table Other Than Iridium

The metal of groups 3 to 10 of the periodic table other than iridium can be Cr, Re, Fe, Ru, Os, Co, Rh, Ni, Pd, Pt, Cu, Au, Zn, Cd or Hg, more preferably Cr, Re, Fe, Ru, Os, Co, Rh, Pt, Cu or Zn, and further preferably Fe, Ru, Os, Co, Rh, Pt, Cu or Zn.

In the following there are shown specific examples of a metal salt or a metal complex including such metal ions, but the present invention is not limited to such examples.

$K_4[Fe(CN)_6]$, $K_3[Fe(CN)_6]$, $K_4[Ru(CN)_6]$, $K_4[Os(CN)_6]$, $K_3[Co(CN)_6]$, $K_3[Rh(CN)_6]$, $K_3[Cr(CN)_6]$, $K_3[Re(CN)_6]$, $K_2[Rh(H_2O)Cl_5]$, $K_3[RhCl_6]$, $K_3[RuCl_6]$, $K_3[ReCl_6]$, $K_3[RuBr_6]$, $K_3[OsCl_6]$, $K_3[CrCl_6]$, $K_3[RhBr_6]$, $K_2[Ru(H_2O)Cl_5]$, $K_2[Pd(CN)_4]$, $K_2[PdCl_4]$, $K_2[PdBr_4]$, $K_2[Pd(NO_2)_4]$, $K_2[Pd(SCN)_4]$, $K_2[Pt(CN)_4]$, $K_2[PtCl_4]$, $K_2[PtBr_4]$, $K_2[PtI_4]$, $K_2[Pt(NO_2)_4]$, $K_2[Pt(SCN)_4]$, $K_2[Pt(NO_2)_2(NH_3)_2]$, trans-$[PtCl_2(NH_3)_2]$, cis-$[PtCl_2(NH_3)_2]$, $K_2[Co(NCO)_4]$, $K_2[CoCl_4]$, $[CoCl_2(H_2O)_2]$, $K_2[Ni(CN)_4]$, $K_2[NiCl_4]$, $K_2[Ni(SCN)_4]$, $K[Au(CN)_4]$, $K[AuCl_4]$, $K[AuI_4]$, $K[Pt(CN)_3(py)]$, wherein py indicates pyridine, $K[Pd(CN)_3(py)]$, $K[Pt(CN)_2(bpy)]$, wherein bpy indicates 2,2'-bipyridine, $K[Pd(CN)_2(bpy)]$, $K[Pt(CN)_3(pyz)]$, wherein pyz indicates pyrazine, $K[Pd(CN)_3(pyz)]$, $[Pt(CN)(py)_3]Cl$, $[Pt(CN)(pyz)_3]Cl$, $[Pt(pyz)_2Cl_2]$, $[Fe(py)_4Cl_2]$, $K_4[Pd(py)_2Cl_2]$, $[Co(py)_2Cl_2]$, $[Ag(py)_4Cl_2]$, $K[Pt(CN)_3(py)]$, $K[Zn(CN)_3(py)]$, $[Zn(CN)_2(bpy)]$, $[Zn(CN)_2Cl_2]$, $K[Zn(CN)_3(pyz)]$, $K_2[Zn(CN)_4]$, $K_2[ZnCl_4]$, $K_2[ZnI_4]$, $K_2[Cu(CN)_3(py)]$, $K[Cu(CN)_2(bpy)]$, $K_3[Cu(CN)_2Cl_2]$, $K_2[Cu(CN)_3(pyz)]$, $K_3[Cu(CN)_4]$, $K_3[CuCl_4]$, $K_3[CuI_4]$, $K[Au(CN)_2(bpy)]$, $K_3[Au(CN)_2Cl_2]$, $K_2[Au(CN)_3(pyz)]$, $K[PtCl_2(Im)_2]$, wherein Im indicates imidazole, $[ZnCl_2(IM)_2]$, $K[PdCl(Im)_3]$, $K[PdCl_2(IM)_2]$, $K[CuCl_2(IM)_2]$, $K[AuCl_2(Im)_2]$, $K[CoCl_3(Im)]$, $[CoCl_2(Im)_2]$, $[CoCl(Im)_3]Cl$, $[Co(IM)_4]Cl_2$, $K[Co(CN)_3(Im)]$, $[Co(CN)_2(Im)_2]$, $[Co(CN)(Im)_3]Cl$, $[CoCl_2(bim)_2]$, wherein bim indicates benzimidazole, $[CoCl(bim)_3]Cl$, $[Co(bim)_4]Cl_2$, $K[Pt(CN)_2(phen)]$, wherein phen indicates 1,10-phenanthroline $[Zn(CN)_2(phen)]$, $K[Cu(CN)_2(phen)]$, $K[Au(CN)_2(phen)]$, and $K[Co(CN)_2(phen)]$.

Such metal is preferably distributed uniformly over the entire silver halide grain, or localized more in the shell portion. More preferably it is localized in the shell portion.

Such metal ions other than iridium can be doped, like the iridium ions, either by adding a metal complex, having such metal ion as a central metal, in a suitable stage of silver halide grain formation thereby causing introduction into the silver halide crystal, or by adding and mixing fine particles doped with such ions in an interim stage of silver halide grain formation or after the grain formation thereby causing a transfer of metal ions from the fine particles to the silver halide crystals.

Such metal ions can be doped into the shell portion either by a direct addition into a reaction vessel prior to formation of silver halide grains or by an addition into a halogen solution for forming the shell portion, at a suitable time, thereby being added together with the halogen solution to the reaction vessel.

A doping amount of such metal ions is preferably $1\times10^{-8}$ to $1\times10^{-2}$ mol per 1 mol of silver halide, more preferably $1\times10^{-7}$ to $1\times10^{-2}$ mol and further preferably $1\times10^{-5}$ to $1\times10^{-3}$ mol.

5-3) Relation of Distributions of Iridium and Metal other than Iridium

In the invention, it is important that iridium is located in the core portion of the silver halide grain. On the other hand, the metal other than iridium is preferably distributed uniformly in the grain or in a larger amount in the shell portion. Consequently the metal doped in the core portion may be iridium only or a mixture of iridium and the metal other than iridium. It is preferable that, in a portion of a grain where iridium is present, an amount of the metal other than iridium is as small as possible.

On the other hand, in the shell portion, it is preferred that iridium is present in a small amount and the doping metal other than iridium is distributed in a larger amount. More preferably the metal other than iridium is present in the absence of iridium.

Between the core portion rich in iridium and the shell portion rich in the metal other than iridium, there may be provided an intermediate region free from both metals.

The photosensitive silver halide grains of the invention may include, as a third metal in addition to iridium and a metal of the group 3 to 10 of the periodic table other than iridium, a metal salt or a metal complex described in JP-A No. 7-225449, JP-A No. 11-65021, paragraphs 0018-0024, and JP-A No. 11-119374, paragraphs 0227-0240.

5-4) Measurement of Distribution of Doped Metals in Grain

A distribution of such doped metals in the photosensitive silver halide grains prepared by the grain forming method of the invention can be measured for example by a method described in JP-A No. 2001-42471. At first, gelatin is separated by an addition of an aquanase aqueous solution and centrifugation. Then the silver halide grains are gradually dissolved from the surface thereof with a silver halide solvent such as an ammonia aqueous solution or an aqueous solution of potassium cyanide, and concentrations of metal ions present in a supernatant liquid are determined by a high frequency induction coupled plasma mass spectroscopy (ICP-MS), a high frequency induction coupled plasma atomic fluorescence spectroscopy (ICP-AFS), or a atomic absorption spectrometry.

6) Gelatin

Various gelatins can be used as gelatin contained in the photosensitive silver halide emulsion to be employed in the invention. In order to maintain a satisfactory dispersion state of the photosensitive silver halide emulsion in a coating solution containing an organic silver salt, it is preferred to use gelatin having a molecular weight of 10,000 to 1,000,000. It is also preferable to apply a phthalizing a substituent of gelatin. Such gelatin may be used at grain formation or at dispersion after desalting process, but is preferably used at the grain formation.

7) Sensitizing Dye

For use in the invention, there can be advantageously selected a sensitizing dye that can spectrally sensitize the silver halide grains in a desired wavelength region upon adsorption thereon and has a spectral sensitivity matching the spectral characteristics of an exposure light source. Examples of sensitizing dye and a method of addition thereof include a description in JP-A No. 11-65021, paragraphs 0103-0109, a compound represented by a general formula (II) in JP-A No. 10-186572, a dye represented by a general formula (I) and a description of a paragraph 0106 in JP-A No. 11-119374, a description in U.S. Pat. No. 5,510,236, a dye described in an example 5 of U.S. Pat. No. 3,871,887, dyes disclosed in JP-A Nos. 2-96131 and 59-48753, and descriptions in EP-A No. 0803764A1, page 19, line 38 to page 20, line 35, and JP-A Nos. 2001-272747, 2001-290238 and 2002-23306. These sensitizing dyes may be used singly or in combination of two or more kinds. In the invention, the sensitizing dye is added to the silver halide emulsion preferably in a period from the end of a desalting process to a coating, and more preferably in a period from the completion of the desalting process to the completion of a chemical ripening process.

An amount of the sensitizing dye added in the invention can be selected according to the desired sensitivity or the desired fog level, but is preferably within a range of $10^{-6}$ to 1 mol per 1 mol of silver halide in a photosensitive layer, preferably $10^{-4}$ to $10^{-1}$ mol.

In the invention, in order to improve the spectral sensitizing efficiency, there may be employed a supersensitizer. Examples of the supersensitizer employable in the invention include compounds described in EP-A No. 587,338, U.S. Pat. Nos. 3,877,943 and 4,873,184 and JP-A Nos. 5-341432, 11-109547 and 10-111543.

8) Chemical Sensitization

The photosensitive silver halide grains to be employed in the invention is preferably chemically sensitized by a sulfur sensitizing method, a selenium sensitizing method or a tellurium sensitizing method. For the sulfur sensitization, the selenium sensitization and the tellurium sensitization, there can be advantageously employed a known compound for example described in JP-A No. 7-128768. In the invention, there is preferred the tellurium sensitization, and more preferred are a compound described in JP-A No. 11-65021, paragraph 0030 and those represented by general formulae (II), (III) and (IV) in JP-A No. 5-313284.

The photosensitive silver halide grains of the invention are preferably chemically sensitized by a gold sensitization method either in combination with the aforementioned chalcogen sensitization or singly. There is preferred a gold sensitizer with monovalent or trivalent gold, and is preferred an ordinarily employed gold compound. Representative examples include chloroauric acid, bromoauric acid, potassium chloroaurate, potassium bromoaurate, auric trichloride, potassium auricthiocyanate, potassium iodoaurate, tetracyanoauric acid, ammonium aurothiocyanate, and pyridyl trichlorogold. In addition, there may also be advantageously employed gold sensitizers described in U.S. Pat. No. 5,858,637 and JP-A No. 2002-278016.

In the invention, the chemical sensitization may be executed any time from grain formation till coating, and can be executed, after desalting, (1) before spectral sensitization, (2) simultaneous with spectral sensitization, (3) after spectral sensitization, or (4) immediately before coating. An amount of the sulfur, selenium or tellurium sensitizer employed in the invention is variable depending on the silver halide grains to be used and chemical ripening conditions, but is within a range of $10^{-8}$ to $10^{-2}$ mol per 1 mol of silver halide, preferably $10^{-7}$ to $10^{-3}$ mol.

Similarly, an amount of the gold sensitizer employed in the invention is variable depending on various conditions, but is generally within a range of $10^{-7}$ to $10^{-3}$ mol per 1 mol of silver halide, preferably $10^{-6}$ to $5\times10^{-4}$ mol.

The condition of the chemical sensitization in the invention is not particularly restricted, but generally the pH may be from 5 to 8, the pAg value may be from 6 to 11 and the temperature may be from 40 to 95° C.

In the silver halide emulsion to be employed in the invention, a thiosulfonic acid compound may be added by a method described in EP-A No. 293,917.

The photosensitive silver halide grains of the invention is preferably treated with a reducing agent. As a specific compound for the reduction sensitization, there is preferred ascorbic acid or thiourea dioxide, and there may also be advantageously employed stannous chloride, aminoiminomethane sulfinic acid, a hydrazine derivative, a borane compound, a silane compound, or a polyamine compound. The reduction sensitizer may be added in any step in the photosensitive emulsion preparing process from a grain growing step to an preparation step immediate before coating. It is also preferred to execute the reduction sensitization by ripening the emulsion at a pH of 7 or higher or at a pAg value of 8.3 or lower, or by introducing a single addition portion of silver ions in the course of grain formation.

The photosensitive silver halide emulsion of the invention preferably includes an FED sensitizer (fragmentable electron donating sensitizer) as a compound for generating two electrons by a photon. As the FED sensitizer, there can be preferably employed compounds described in U.S. Pat. Nos. 5,747,235, 5,747,236, 6,054,260 and 5,994,051 and JP-A No. 2002-287293. The FED sensitizer may be added in any step in the photosensitive emulsion preparing process from a grain growing step to a preparation step immediate before coating. An amount of addition is variable depending on various conditions, but is preferably within a range of $10^{-7}$ to $10^{-1}$ mol per 1 mol of silver halide, more preferably $10^{-6}$ to $5\times10^{-2}$ mol.

9) Combined Use of Silver Halides

In the photosensitive material of the invention, single type of may be used and a combination of two or more types of the photosensitive silver halide emulsion (for example types with different average grain sizes, those with different halogen compositions, those with different crystal habit, or those with different chemical sensitizing conditions) may also be used. A gradation may be regulated by employing photosensitive silver halides of plural types with different sensitivities. Technologies relating thereto are described for example in JP-A Nos. 57-119341, 53-106125, 47-3929, 48-55730, 46-5187, 50-73627 and 57-150841. As to the sensitivity difference, there is preferred a difference of 0.2 logE or larger between the emulsions.

10) Coating Amount

An addition amount of the photosensitive silver halide, represented by a coated silver amount per 1 $m^2$ of the photosensitive material, is preferably 0.03 to 0.6 $g/m^2$, more preferably 0.05 to 0.4 $g/m^2$, and most preferably 0.07 to 0.3 $g/m^2$. The amount of the photosensitive silver halide is preferably within a range of 0.01 to 0.5 mol with respect to 1 mol of organic silver salt, more preferably 0.02 to 0.3 mol and further preferably 0.03 to 0.2 mol.

11) Mixing Method for Photosensitive Silver Halide and Organic Silver Salt

As to a method and conditions of mixing the photosensitive silver halide and the organic silver salt, prepared separately, there may be employed a method of mixing the already prepared silver halide and the organic silver salt with a high-speed agitator, a ball mill, a sand mill, a colloid mill, a vibration mill or a homogenizer, or a method of adding and mixing the already prepared photosensitive silver halide in the course of preparation of the organic silver salt, thereby preparing the organic silver salt, but no particular limitation exists as long as the effect of the invention can be sufficiently exhibited. It is also preferred, for regulating the photographic characteristics, to mix two or more aqueous dispersions of organic silver salts and two or more aqueous dispersions of photosensitive silver salts.

The silver halide of the invention is added to a coating solution for an image forming layer, in a period from 180 minutes before coating to immediately before coating, preferably from 60 minutes before coating to 10 seconds before coating, but a mixing method and a mixing condition are not particularly restricted as long as the effect of the invention can be sufficiently exhibited. Specific examples of the mixing method include a mixing method in a tank, so as to obtain a desired average stay time calculated from an addition flow rate and a liquid supply rate to a coater, and a method of using a static mixer described for example in N. Harnby and M. F. Edwards and A. W. Nienow, "Ekitai Kongou Gijutsu" (Liquid mixing technology), translated by Koji Takahashi and published by Nikkan Kogyo Shimbun, 1989, Chapter 8.

1-2. Organic Silver Salt

The organic silver salt employable in the invention is any silver salt that is relatively stable to light but functions as a silver ion supplying substance when heated to 80° C. or higher in the presence of an exposed photosensitive silver halide and a reducing agent, thereby forming a silver image. The organic silver salt can be an arbitrary organic substance that can be reduced by the reducing agent and can supply silver ions. Such non-photosensitive organic silver salt is described for example in JP-A No. 10-62899, paragraphs 0048-0049, EP-A No. 0803764A1, page 18, line 24 to page 19, line 37, EP-A No. 0962812A1, and JP-A Nos. 11-349591, 2000-7683 and 2000-72711. There is preferred a silver salt of an organic acid, particularly a silver salt of a long-chain aliphatic carboxylic acid (with 10 to 30 carbon atoms, preferably 15 to 28 carbon atoms). Preferred examples of the fatty acid silver salt include silver lignoserate, silver behenate, silver arachidate, silver stearate, silver oleate, silver laurate, silver caproate, silver myristate, silver palmitate, silver erucate and a mixture thereof. In the invention it is preferred, among these fatty acid silver salts, to use an fatty acid silver salt having a silver behenate content of 50 mol % or higher, more preferably 85 mol % or higher and further preferably 95 mol % or higher.

A shape of the organic silver salt employable in the invention is not particularly restricted, and may have an acicular shape, a rod shape, a flat shape or a scale shape.

In the invention, there is preferred an organic silver salt of scale shape. There is also advantageously employed a grain of a short acicular form with a ratio of a longer axis and a shorter axis not exceeding 5, a rectangular parallelepiped or cubic particle or a potato-like amorphous shape. These organic silver grains have an advantage of a lower fog level at thermal development in comparison with a grain of a long acicular shape having a ratio of a longer axis and a shorter axis equal to or larger than 5. In particular, a grain with a ratio of a longer axis and a shorter axis equal to or less than 3 is preferable because of an improved mechanical stability of the coated film. In the present specification, the organic silver salt of scale shape is defined in the following manner. The organic silver salt is observed under an electron microscope, and the grain shape is approximated by a rectangular parallelepiped with sides a, b and c in the increasing order (c may be equal to b), and following value x is determined with the smaller values a and b in the following manner:

$$x=b/a$$

The value x is determined for about 200 grains to determine an average value x(average), and a scale shape is defined by a relation x(average)≧1.5. There is preferred a relation 30≧x (average)≧1.5, more preferably 20≧x(average)≧2.0. For reference, an acicular shape is defined by 1≦x(average)<1.5.

In a scale-shaped grain, the value "a" can be regarded as a thickness of a flat grain having a principal plane defined by sides b and c. An average of the value a is preferably within a range from 0.01 to 0.23 μm, more preferably from 0.1 to 0.23 μm. Also an average of c/b is preferably within a range from 1 to 6, more preferably 1 to 4, further preferably from 1 to 3, and particularly preferably from 1 to 2.

A grain size distribution of the organic silver salt is preferably monodispersion. Monodispersion means that a percentage of a standard deviation of each length of the shorter axis and longer axis, divided respectively by the shorter axis and the longer axis, is preferably 100% or less, more preferably 80% or less and further preferably 50% or less. The shape of the organic silver salt can be measured from a transmission electron microscope image of an organic silver salt dispersion. The monodispersion property can also be measured by determining a standard deviation of a volume-weighted average diameter of the organic silver salt, and a percentage (variation coefficient) of a value obtained by dividing the standard deviation of a volume-weighted average diameter with the volume-weighted average diameter is preferably 100% or less, more preferably 80% or less and further preferably 50% or less. Such measurement can be executed with a commercially available laser-scattering particle size measuring apparatus.

For manufacturing and dispersing the organic silver salt to be employed in the invention, there can be used a known method. For example, reference may be made to JP-A No. 10-62899, EP-A Nos. 0803763A1 and 0962812A1, JP-A Nos. 11-349591, 2000-7683 and 2000-72711, JP-A Nos. 2001-163889, 2001-163890, 2001-163827, 2001-033907, 2001-188313, 2001-083652, 2002-006442, 2002-031870, and 2002-006442, Japanese Patent Applications No. 2000-214155.

Since the presence of a photosensitive silver salt at the dispersion of the organic silver salt increases the fog level and significantly decreases the sensitivity, it is preferable that the photosensitive silver salt is substantially absent at the dispersion. In the invention, the amount of the photosensitive silver salt in an aqueous dispersion to be dispersed is preferably 1 mol % or less per 1 mol of organic silver salt in such dispersion, more preferably 0.1 mol % or less and further preferably no active addition of photosensitive silver salt is executed.

In the invention, the photosensitive material can be prepared by mixing an aqueous dispersion of the organic silver salt and an aqueous dispersion of the photosensitive silver salt, and the mixing ratio of the organic silver salt and the photosensitive silver salt can be selected according to the purpose, but a proportion of the photosensitive silver salt to the organic silver salt is preferably within a range of 0.5 to 15 mol %, more preferably 0.5 to 12 mol %, and particularly preferably 1 to 7 mol %. At the mixing, there is preferably employed a method of mixing two or more aqueous dispersions of the organic silver salt and two or more aqueous dispersions of the photosensitive silver salt, in order to regulate the photographic characteristics.

The organic silver salt of the invention may be employed in a desired amount, but a total coated silver amount including silver halide is preferably within a range of 0.1 to 5.0 g/m$^2$, more preferably 0.3 to 3.0 g/m$^2$, further preferably 0.5 to 2.0 g/m$^2$. Particularly for improving the image preservability, there is preferred a total coated silver amount of 1.8 g/m$^2$ or less, more preferably 1.6 g/m$^2$ or less. The preferred reducing agent of the present invention allows to obtain a sufficient image density even with such low silver amount.

1-3. Reducing Agent

The photothermographic material of the invention preferably includes a thermal development agent which is a reducing agent for the organic silver salt. The reducing agent for the organic silver salt can be an arbitrary substance (preferably organic substance) capable of reducing a silver ion into metallic silver. Examples of such reducing agent are described in JP-A No. 11-65021, paragraphs 0043-0045 and EP-A No. 0803764A1, page 7, line 34 to page 18, line 12.

A preferred reducing agent employed in the invention is preferably a compound represented by a following general formula (R), and such compound will be detailedly explained in the following.

General formula (R)

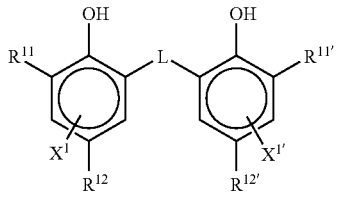

In the general formula (R), $R^{11}$ and $R^{11'}$ each independently represents an alkyl group with 1 to 20 carbon atoms; $R^{12}$ and $R^{12'}$ each independently represents a hydrogen atom or a substituent that can substitute the benzene ring; L represents —S— or —CHR$^{13}$—; $R^{13}$ represents a hydrogen atom or an alkyl group with 1 to 20 carbon atoms; and $X^1$ and $X^{1'}$ each independently represents a hydrogen atom or a group that can substitute the benzene ring.

In the following, there will be given a detailed explanation on each substituent.

1) $R^{11}$ and $R^{11'}$ $R^{11}$ and $R^{11'}$ each independently represents a substituted or non-substituted alkyl group with 1 to 20 carbon atoms. A substituent on the alkyl group is not particularly limited, but is preferably an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group or a halogen atom.

2) $R^{12}$ and $R^{12'}$, $X^1$ and $X^{1'}$ $R^{12}$ and $R^{12'}$ each independently represents a hydrogen atom or a group that can substitute the benzene ring.

$X^1$ and $X^{1'}$ each independently represents a hydrogen atom or a group that can substitute the benzene ring. Each group that can substitute the benzene ring can preferably be an alkyl group, an aryl group, a halogen atom, an alkoxy group or an acylamino group.

3) L

L represents a —S— group or a —$CHR^{13}$— group. $R^{13}$ represents a hydrogen atom or an alkyl group with 1 to 20 carbon atoms, and the alkyl group may have a substituent.

Specific examples of the non-substituted alkyl group of $R^{13}$ include a methyl group, an ethyl group, a propyl group, a butyl group, a heptyl group, an undecyl group, an isopropyl group, a 1-ethylpentyl group and 2,4,4-trimethylpentyl group.

Examples of the substituent of the alkyl group are similar to those of the substituent of $R^{11}$, and include a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group and a sulfamoyl group.

4) Preferred Substituent

Each of $R^{11}$ and $R^{11'}$ is preferably a secondary or tertiary alkyl group with 3 to 15 carbon atoms, and can specifically be an isopropyl group, an isobutyl group, a t-butyl group, a t-amyl group, a t-octyl group, a cyclohexyl group, a cyclopentyl group, a 1-methylcyclohexyl group or a 1-methylcyclopropyl group. Each of $R^{11}$ and $R^{11'}$ is more preferably a tertiary alkyl group with 4 to 12 carbon atoms, among which more preferred is a t-butyl group, a t-amyl group or a 1-methylcyclohexyl group and most preferred is a t-butyl group.

Each of $R^{12}$ and $R^{12'}$ is preferably an alkyl group with 1 to 20 carbon atoms, and can specifically be a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, or a methoxyethyl group. More preferably it can be a methyl group, an ethyl group, a propyl group, an isopropyl group or a t-butyl group.

Each of $X^1$ and $X^{1'}$ is preferably a hydrogen atom, a halogen atom, or an alkyl group, more preferably a hydrogen atom.

L represents preferably a —$CHR^{13}$— group.

$R^{13}$ preferably represents a hydrogen atom or an alkyl group with 1 to 15 carbon atoms, and, for the alkyl group, there is preferred a methyl group, an ethyl group, a propyl group, an isopropyl group or a 2,4,6-trimethylpentyl group. For $R^{13}$, there is particularly preferred a hydrogen atom, a methyl group, a propyl group or an isopropyl group.

In the case $R^{13}$ is a hydrogen atom, each of $R^{12}$ and $R^{12'}$ is preferably an alkyl group with 2 to 5 carbon atoms, more preferably an ethyl group or a propyl group and most preferably an ethyl group.

In the case $R^{13}$ is a primary or secondary alkyl group with 1 to 8 carbon atoms, each of $R^{12}$ and $R^{12'}$ is preferably a methyl group. As the primary or secondary alkyl group with 1 to 8 carbon atoms for $R^{13}$, there is more preferred a methyl group, an ethyl group, a propyl group or an isopropyl group, and further preferred is a methyl group, an ethyl group or a propyl group.

In the case all of $R^{11}$, $R^{11'}$, $R^{12}$ and $R^{12'}$ are methyl groups, $R^{13}$ is preferably a secondary alkyl group. As the secondary alkyl group for $R^{13}$, there is preferred an isopropyl group, an isobutyl group or a 1-ethylpentyl group, and more preferred is an isopropyl group.

The aforementioned reducing agent shows different thermal development properties by a combination of $R^{11}$, $R^{11'}$, $R^{12}$, $R^{12'}$ and $R^{13}$. Such thermal development properties can be regulated by employing two or more reducing agents in various mixing ratio, and it is preferred to employ two or more reducing agents in combination according to the purpose.

In the following, specific examples of the compound of the invention represented by the general formula (R) are shown, but the present invention is not limited to such examples.

(R-1)

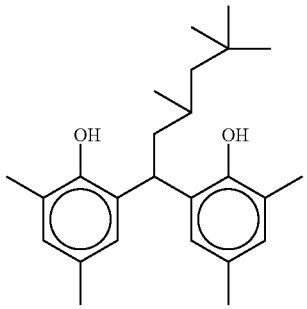

(R-2)

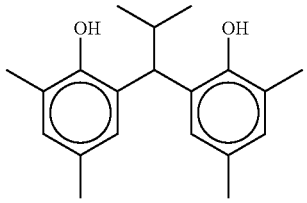

(R-3)

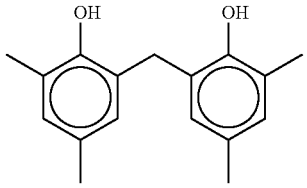

(R-4)

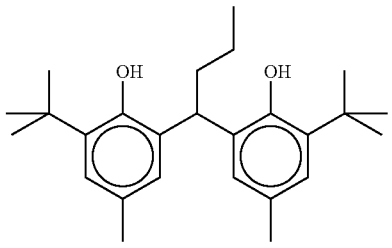

(R-5)

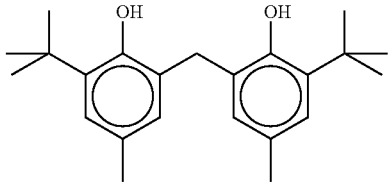

-continued
(R-6)
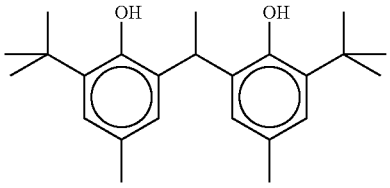
(R-7)
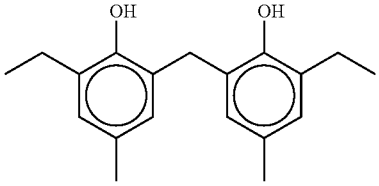
(R-8)
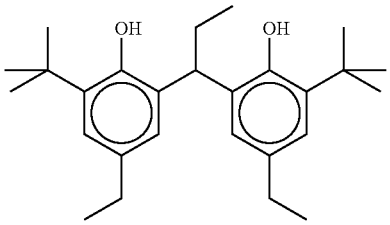
(R-9)
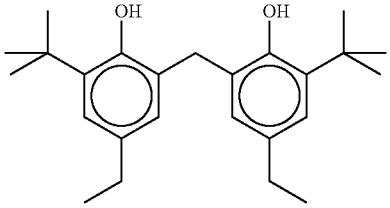
(R-10)
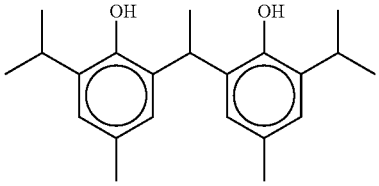
(R-11)
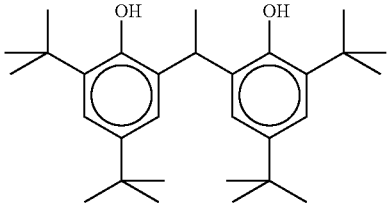
-continued
(R-12)
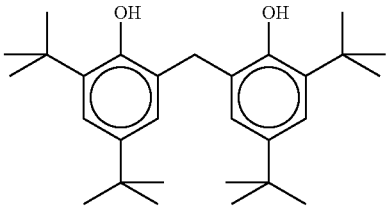
(R-13)
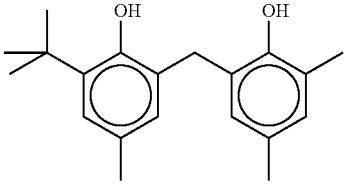
(R-14)
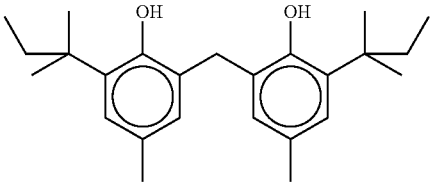
(R-15)
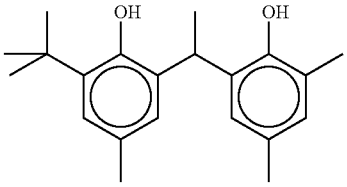
(R-16)
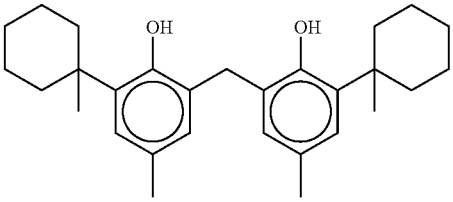
(R-17)
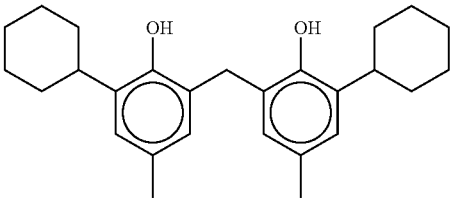
(R-18)
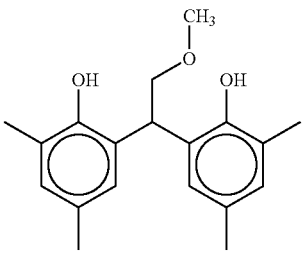

-continued
(R-19)
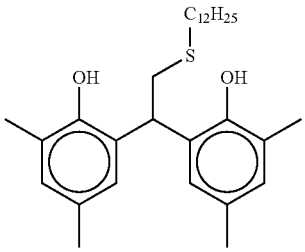
(R-20)
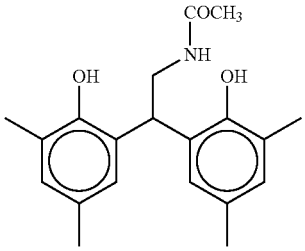
(R-21)
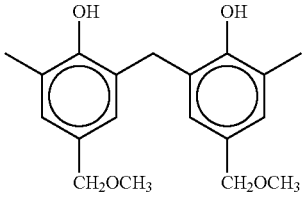
(R-22)
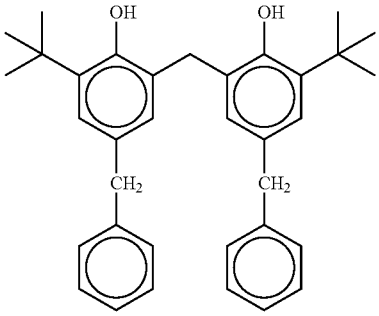
(R-23)
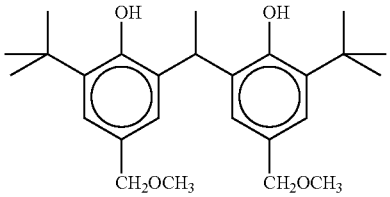
-continued
(R-24)
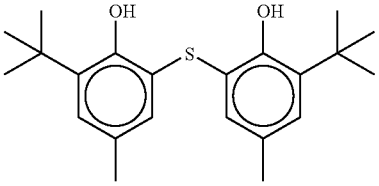
(R-25)
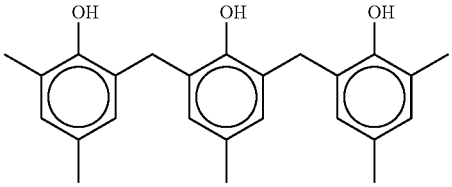
(R-26)
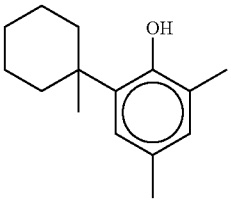
(R-27)
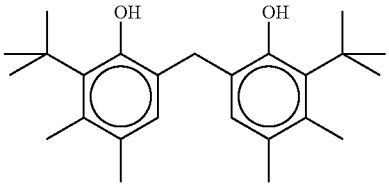
(R-28)
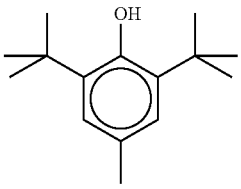
(R-29)
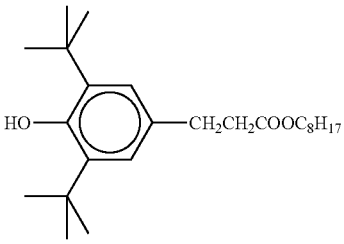
(R-30)
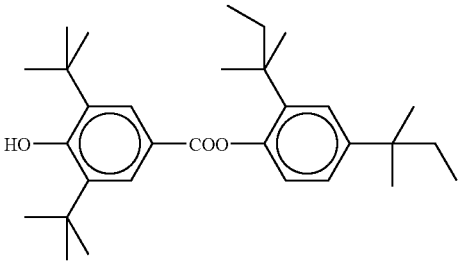

-continued (R-31)

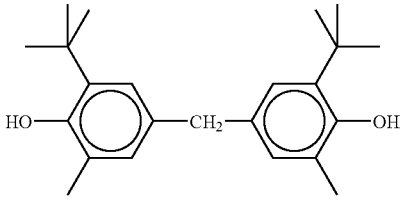

(R-32)

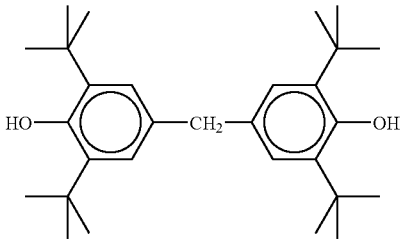

(R-33)

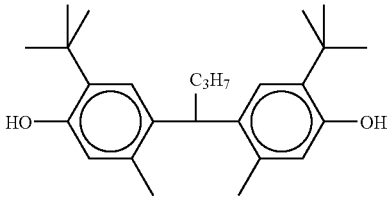

(R-34)

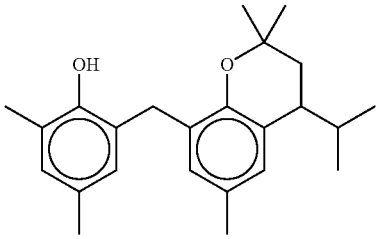

In the invention, the reducing agent is preferably added in an amount of 0.01 to 5.0 g/m$^2$, more preferably 0.1 to 3.0 g/m$^2$, and is preferably included in an amount of 5 to 50 mol % per 1 mol of silver on the surface having the image forming layer, more preferably 10 to 40 mol %.

The reducing agent of the invention may be added in an image forming layer including the organic silver salt and the photosensitive silver halide, or a layer adjacent thereto, but is preferably contained in the image forming layer.

The reducing agent of the invention may be contained in the coating solution and in the photosensitive material by any method, for example in a state of a solution, an emulsified dispersion or a dispersion of solid fine particles.

A particularly preferred addition method is a method of solid fine particles dispersion. It is added in a state of fine particles having an average particle size of 0.01 to 10 μm, preferably 0.05 to 5 μm, more preferably 0.1 to 1 μm.

1-4. Development Accelerator

In the photothermographic material of the invention, there is preferably employed, as a development accelerator, a sulfonamidephenol compound represented by a general formula (A) in JP-A Nos. 2000-267222 and 2000-330234, a hindered phenol compound represented by a general formula (II) in JP-A No. 2001-92075, a hydrazine compound represented by a general formula (I) in JP-A Nos. 10-62895 and 11-15116 and by a general formula (1) in JP-A No. 2002-278017, or a phenol or naphthol compound represented by a general formula (2) in JP-A No. 2001-264929. Such development accelerator is used within a range of 0.1 to 20 mol % with respect to the reducing agent, preferably 0.5 to 10 mol % and more preferably 1 to 5 mol %. It is preferably introduced into the photosensitive material, like the reducing agent, in a state of a dispersion of solid fine particles.

In the invention, among the aforementioned development accelerators, particularly preferred are the hydrazine compound represented by a general formula (1) in JP-A No. 2002-278017 and a phenol or naphthol compound represented by a general formula (2) in JP-A No. 2001-264929.

In the following specific preferred examples of the development accelerator of the invention are shown, but the invention is not limited to such examples.

(A-1)

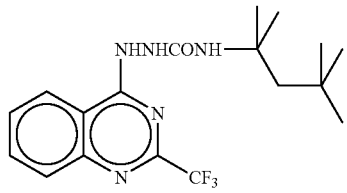

(A-2)

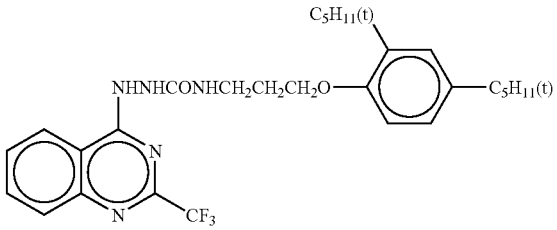

(A-3)

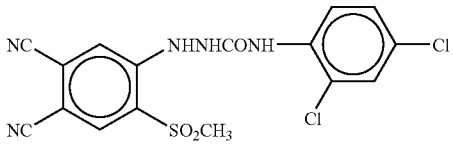

(A-4)

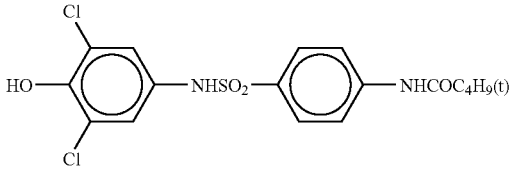

(A-5)

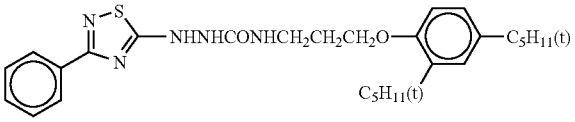

(A-6)

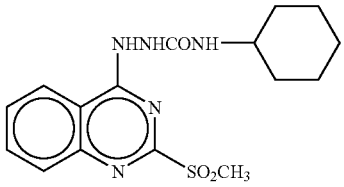

-continued (A-7)

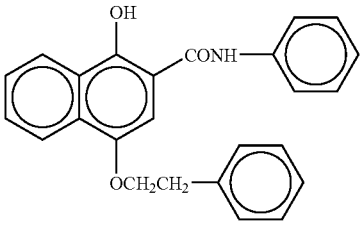

(A-8)

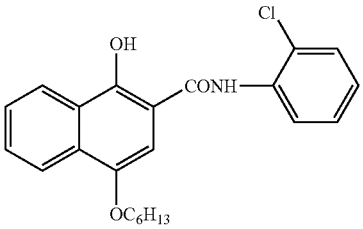

(A-9)

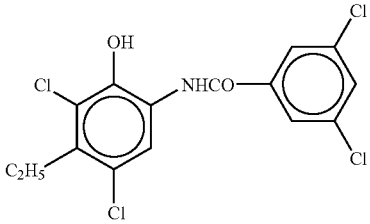

(A-10)

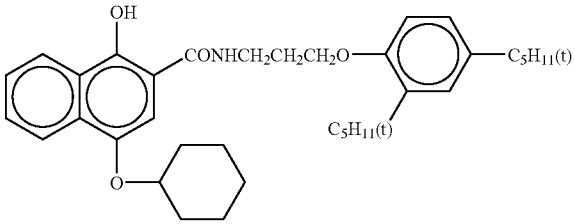

1-5. Hydrogen Bonding Compound

In the invention, it is preferred to also use a non-reducible compound having a group capable of forming a hydrogen bond with an aromatic hydroxyl (—OH) group of the reducing agent.

A group capable of forming a hydrogen bond can be, for example, a phosphoryl group, a sulfoxide group, a sulfonyl group, a carbonyl group, an amide group, an ester group, an urethane group, an ureide group, a tertiary amino group or a nitrogen-containing aromatic group. Among these preferred is a compound having a phosphoryl group, a sulfoxide group, an amide group (not including >N—H and blocked as in >N—Ra (Ra being a substituent other than hydrogen atom)), an urethane group (not including >N—H and blocked as in >N—Ra (Ra being a substituent other than hydrogen atom)), or an ureide group (not including >N—H and blocked as in >N—Ra (Ra being a substituent other than hydrogen atom)).

In the invention, a particularly preferred hydrogen bonding compound is presented by a following general formula (D):

General formula (D)

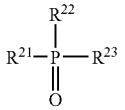

In the general formula (D), $R^{21}$ to $R^{23}$ each independently represents an alkyl group, an aryl group, an alkoxy group, an aryloxy group, an amino group or a heterocyclic group, which may be non-substituted or may have a substituent.

In the case any of $R^{21}$ to $R^{23}$ has a substituent, such substituent can be a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group or a phosphoryl group, among which preferred is an alkyl group or an aryl group such as a methyl group, an ethyl group, an isopropyl group, a t-butyl group, a t-octyl group, a phenyl group, a 4-alkoxyphenyl group or a 4-acyloxyphenyl group.

Specific examples of an alkyl group constituting any of $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenetyl group, and a 2-phenoxypropyl group.

Specific examples of the aryl group include a phenyl group, a cresyl group, a xylyl group, a naphthyl group, a 4-t-butylphenyl group, a 4-t-octylphenyl group, a 4-anisidyl group and a 3,5-dichlorophenyl group.

Specific examples of the alkoxy group include a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group and a benzyloxy group.

Specific examples of the aryloxy group include a phenoxy group, a cresyloxy group, an isopropylphenoxy group, a 4-t-butylphenoxy group, a naphthoxy group and a biphenyloxy group.

Specific examples of the amino group include a dimethylamino group, a diethylamino group, a dibutylamino group, a dioctylamino group, an N-methyl-N-hexylamino group, a dicyclohexylamino group, a diphenylamino group and an N-methyl-N-phenylamino group.

Each of $R^{21}$ to $R^{23}$ is preferably an alkyl group, an aryl group, an alkoxy group, or an aryloxy group. For the effect of the invention, it is preferred that at least one of $R^{21}$ to $R^{23}$ is an alkyl group or an aryl group, and more preferred that each of two or more is an alkyl group or an aryl group. It is also preferred that $R^{21}$ to $R^{23}$ are same groups, in consideration of inexpensive availability.

In the following, specific examples of the hydrogen bonding compound of the invention, including the compound represented by the general formula (D), are shown, but the invention is not limited to such examples.

(D-1)
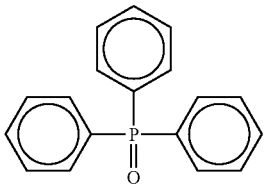
(D-2)
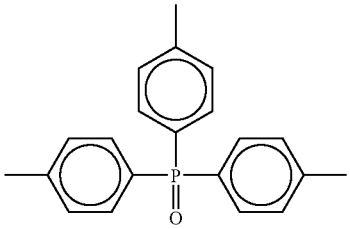
(D-3)
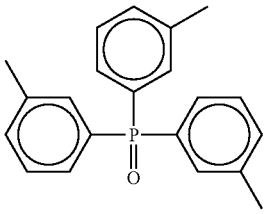
(D-4)
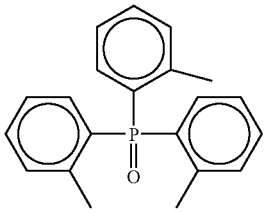
(D-5)
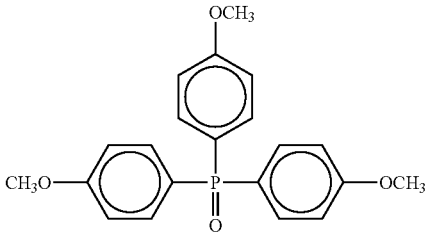
(D-6)
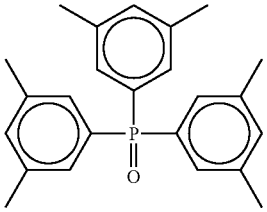
(D-7)
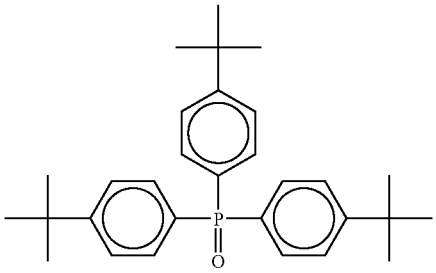
-continued
(D-8)
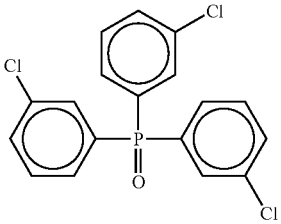
(D-9)
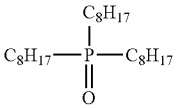
(D-10)
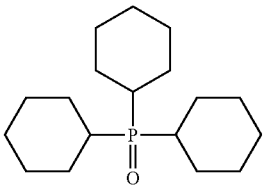
(D-11)
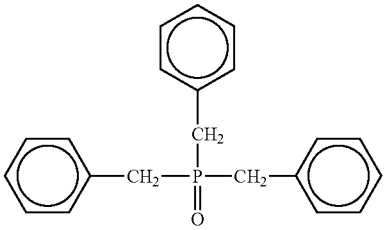
(D-12)
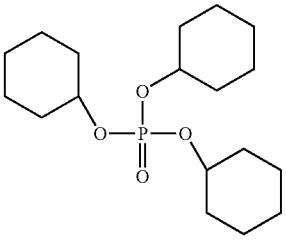
(D-13)
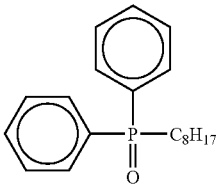
(D-14)
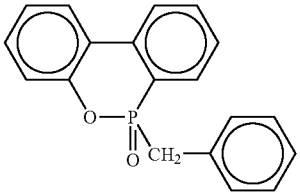
(D-15)
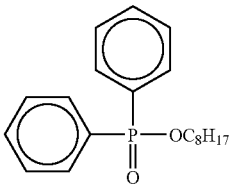

-continued (D-16)

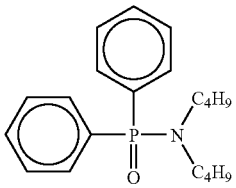

(D-17)

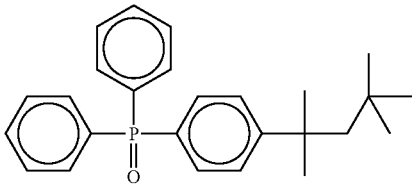

(D-18)

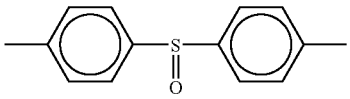

(D-19)

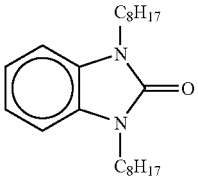

(D-20)

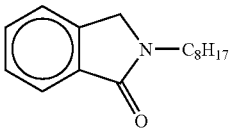

(D-21)

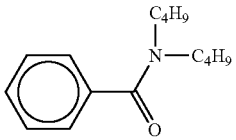

Specific examples of the hydrogen bonding compound, other than those in the foregoing, are described in JP-A Nos. 2001-281793 and 2002-014438.

The hydrogen bonding compound of the invention, like the reducing agent, may be contained in the coating solution and used in the photosensitive material for example in a form of a solution, an emulsified dispersion or a dispersion of solid fine particles. The compound of the invention forms, in a solution state, a complex by a hydrogen bonding with a compound having a phenolic hydroxyl group, and the complex may be isolated in a crystalline state depending on the combination of the reducing agent and the compound of the general formula (D).

It is particularly preferable, for obtaining a stable performance, to use thus isolated crystalline powder in a dispersion of solid fine particles. There is also preferably employed a method of mixing the reducing agent and the hydrogen bonding compound of the invention in a powder state, and forming a complex at the dispersion in a sand grinder mill or the like with a suitable dispersant.

The hydrogen bonding compound of the invention is preferably used within a range of 1 to 200 mol % with respect to the reducing agent, more preferably within a range of 10 to 150 mol % and further preferably 30 to 100 mol %.

1-6. Binder

A binder for the layer containing the organic silver salt of the invention can be any polymer, and a preferred binder is transparent or semi-transparent, generally colorless and is formed by a natural resin, polymer or copolymer, a synthetic resin, polymer or copolymer, or another film-forming substance, for example a gelatin, a rubber, a poly(vinyl alcohol), a hydroxyethyl cellulose, a cellulose acetate, a cellulose acetate butyrate, a poly(vinylpyrrolidone), casein, starch, a poly(acrylic acid), a poly(methyl methacrylate), a poly(vinyl chloride), a poly(methacrylic acid), a styrene-maleic anhydride copolymer, a styrene-acrylonitrile copolymer, a styrene-butadiene copolymer, a poly(vinylacetal) (such as poly (vinylformal) or poly(vinylbutyral)), a poly(ester), a poly (urethane), a phenoxy resin, a poly(vinylidene chloride), a poly(epoxide), a poly(carbonate), a poly(vinyl acetate), a poly(olefin), a cellulose ester, or a poly(amide). A coat can be formed by the binder in a form of aqueous solution, an organic solvent solution or an emulsion.

In the layer containing the organic silver salt of the invention, the binder preferably has a glass transition temperature within a range of −20 to 80° C., more preferably 0 to 70° C. and further preferably 10 to 60° C.

In the present specification, the glass transition temperature Tg is calculated by a following equation:

$$1/Tg=\Sigma(Xi/Tgi)$$

It is assumed that the polymer is formed by copolymerization of n monomer components from i=1 to n. Xi indicates a weight proportion of an i-th monomer (ΣXi=1), Tgi indicates a glass transition temperature (absolute temperature) of a homopolymer of an i-th monomer, and Σ indicates a summation from i=1 to n.

The glass transition temperature (Tgi) of a homopolymer of each monomer was obtained from Polymer Handbook (3rd edition) (J. Brandrup, E. H. Immergut (Wiley-Interscience, 1989)).

Single polymer can be used for constituting the binder, or a combination of two or more kinds of polymer can be used. It is also possible to use a polymer with a glass transition temperature of 20° C. or higher and a polymer with a glass transition temperature less than 20° C. in combination. In the case of using two or more polymers with different Tg values as a blend, it is preferred that a weight-average Tg falls within the aforementioned range.

In the invention, the performance is improved in the case the organic silver salt containing layer is formed by coating and drying a coating solution in which water occupies 30 mass % or more of the solvent, further in the case the binder of the organic silver salt containing layer is soluble or dispersible in an aqueous solvent (water solvent), and particularly in the case the binder is formed by a latex of a polymer with an equilibrium water content of 2 mass % or less in an environment of 25° C. and 60% RH.

A most preferred form is a preparation having an ionic conductivity of 2.5 mS/cm or less, and such preparation can be obtained, after a polymer synthesis, by purification with a separation membrane.

The aforementioned aqueous solvent in which the polymer is soluble or dispersible is water, or a mixture of water and a water-miscible organic solvent in which the amount of the organic solvent does not exceed 70 mass %.

The water-miscible organic solvent can be, for example, an alcohol such as methyl alcohol, ethyl alcohol and propyl alcohol, a cellosolve such as methyl cellosolve, ethyl cellosolve and butyl cellosolve, ethyl acetate and dimethylformamide.

Also the "equilibrium water content in an environment of 25° C. and 60% RH" can be represented, with a polymer weight W1 in a moisture equilibrium state under an environment of 25° C. and 60% RH and a polymer weight WO in an absolute dry state at 25° C., as follows:

$$\text{equilibrated water content in an environment of 25° C. and 60\% RH} = [(W1-W0)/W0]\times 100 \text{ (mass \%)}$$

For the definition of the water content and the measuring method therefor, reference can be made for example to Kobunshi Kogaku Koza 14, Kobunshi Zairyo Shikenho (polymer engineering couarse 14, testing method for polymer material) (edited by Society of Polymer Science, publiched by Chijinshokan).

The binder polymer of the invention preferably has an equilibrium water content of 2 mass % or less in an environment of 25° C. and 60% RH, more preferably 0.01 to 1.5 mass %, and further preferably 0.02 to 1 mass %.

The binder of the invention is particularly preferably a polymer dispersible in an aqueous solvent. Examples of a dispersion state include a latex in which fine particles of a water-insoluble hydrophobic polymer is dispersed and a dispersion in which polymer molcules are dispersed in a molecular state or forming micelles, both of which can be used advantageously. The dispersed particles preferably have an average particle size of 1 to 50,000 nm, more preferably 5 to 1,000 nm. The particle size distribution of the dispersed particles is not particularly limited, and can be a wide particle size distribution or a mono-dispersed particle size distribution.

In the invention, as the polymer dispersible in the aqueous solvent, there can be preferably employed a hydrophobic polymer such as an acrylic polymer, a poly(ester), a rubber (for example SBR resin), a poly(urethane), a poly(vinyl chloride), a poly(vinyl acetate), poly(vinylidene chloride) or a poly(olefin). Such polymer can be a straight polymer, a branched polymer or a crosslinked polymer, or can also be so-called homopolymer formed by polymerization of a single monomer, or copolymer formed by polymerization of two or more monomers. The copolymer can also be a random copolymer or a block copolymer.

Such polymer has a number-average molecular weight of 5,000 to 1,000,000, preferably 10,000 to 200,000. An excessively small molecular weight results in an insufficient mechanical strength of the emulsion layer, while an excessively large molecular weight results in an undesirably inferior film forming property.

Specific examples of the preferable polymer latex include those listed in the following. Following examples are represented by monomers used as the raw material, with a parenthesized number indicating mass % and a molecular weight represented by a number-average molecular weight. In an example employing a polyfunctional monomer, since the concept of molecular weight is not applicable because of a crosslinked structure, it is represented as crosslinking and the description of the molecular weight is omitted. Tg indicates a glass transition temperature:

P-1: latex of -MMA(70)-EA(27)-MAA(3)-(molecular weight 37,000, Tg 61° C.)

P-2: latex of -MMA(70)-2EHA(20)-St(5)-AA(5)-(molecular weight 40,000, Tg 59° C.)

P-3: latex of -St(50)-Bu(47)-MAA(3)-(crosslinking, Tg -17° C.)

P-4: latex of-St(68)-Bu(29)-AA(3)-(crosslinking, Tg 17° C.)

P-5: latex of -St(71)-Bu(26)-AA(3)-(crosslinking, Tg 24° C.)

P-6: latex of -St(70)-Bu(27)—IA(3)-(crosslinking)

P-7: latex of -St(75)-Bu(24)-AA(1)-(crosslinking, Tg 29° C.)

P-8: latex of -St(60)-Bu(35)-DVB(3)-MAA(2)-(crosslinking)

P-9: latex of -St(70)-Bu(25)-DVB(2)-AA(3)-(crosslinking)

P-10: latex of -VC(50)-MMA(20)-EA(20)-AN(5)-AA(5)-(molecular weight 80,000)

P-11: latex of -VDC(85)-MMA(5)-EA(5)-MAA(5)-(molecular weight 67,000)

P-12: latex of -Et(90)-MMA(10) (molecular weight 12,000)

P-13: latex of -St(70)-2EHA(27)-AA(3)-(molecular weight 130,000, Tg 43° C.)

P-14: latex of -MMA(63)-EA(35)-AA(2)-(molecular weight 33,000, Tg 47° C.)

P-15: latex of -St(70.5)-Bu(26.5)-AA(3)-(crosslinking, Tg 23° C.)

P-16: latex of -St(69.5)-Bu(27.5)-AA(3)-(crosslinking, Tg 20.5° C.)

In the foregoing, the abbreviations represent following monomers: MMA: methyl methacrylate, EA: ethyl acrylate, MMA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, and IA: itaconic acid.

The polymers mentioned in the foregoing are also commercially available, and following ones can be utilized. Examples of acrylic polymer include Cebien A-4635, 4718, 4601 (Daicel Chemical Industries, Ltd.), Nipol Lx 811, 814, 821, 820, 857 (Zeon Corp.) etc.; examples of poly(ester) include FINETEX ES 650, 611, 675, 850 (Dainippon Ink and Chemicals Inc.), WD-size, WMS (Eastman Chemical Co.) etc.; examples of poly(urethane) include HYDRAN AP 10, 20, 30, 40 (Dainippon Ink and Chemicals Inc.) etc.; examples of rubber include LACSTAR 7310K, 3307B, 4700H, 7132C (Dainippon Ink and Chemicals Inc.), Nipol Lx 416, 410, 438C, 2507 (Zeon Corp.) etc.; examples of poly(vinyl chloride) include G351, G576 (Zeon Corp.) etc.; examples of poly(vinylidene chloride) include L502, L513 (Asahi Chemical Industries Ltd.) etc.; examples of poly(olefin) include Chemipar S120, SA100 (Mitsui Chemical Co.) etc.

Single kind of these polymer latices may be used, or a blend of two or more kinds of these polymer latices may be used according to the necessity.

The polymer latex used in the invention is particularly preferably a latex of a styrene-butadiene copolymer. In the styrene-butadiene copolymer, a weight ratio of a styrene monomer unit and a butadiene monomer unit is preferably 40:60 to 95:5. Also the styrene monomer unit and the butadiene monomer unit preferably occupy a proportion, in the copolymer, within a range of 60 to 99 mass %. A preferred range of the molecular weight is same as mentioned before.

Preferred examples of a styrene-butadiene copolymer latex that can be used in the invention include P-3 to P-8, P-14 and P-15 mentioned in the foregoing and LACSTAR 3307B, 7132C and Nipol Lx 416 which are commercially available.

In the organic silver salt containing layer of the photosensitive material of the invention, there may be added, if necessary, a hydrophilic polymer such as gelatin, polyvinyl alcohol, methyl cellulose, hydroxypropyl cellulose, or carboxymethyl cellulose.

An addition amount of such hydrophilic polymer is preferably 30 mass % or less with respect to the total binder in the organic silver salt containing layer, more preferably 20 mass % or less.

The organic silver salt containing layer (namely image forming layer) of the invention is preferably formed by employing a polymer latex as a binder. An amount of the binder in the organic silver salt containing layer is, in a weight ratio of total binder/organic silver salt, preferably within a range from 1/10 to 10/1, more preferably 1/5 to 4/1.

Such organic silver salt containing layer is usually also a photosensitive layer (emulsion layer) including a photosensitive silver halide which is a photosensitive silver salt, and, in such case, a weight ratio of total binder/silver halide is preferably within a range of 400 to 5, more preferably 200 to 10.

In the image forming layer of the invention, an amount of total binder is preferably 0.2 to 30 g/m$^2$, more preferably 1 to 15 g/m$^2$. In the image forming layer of the invention, there may be added a crosslinking agent for crosslinking, or a surfactant for improving the coating property.

In a coating solution for the organic silver salt containing layer of the photosensitive material of the invention, a solvent (indicating solvent and dispersing medium collectively, for the purpose of simplicity) is preferably an aqueous solvent containing water by 30 mass % or higher. A component other than water can be any water-miscible organic solvent, such as methyl alcohol, ethyl alcohol, isopropyl alcohol, methyl cellosolve, ethyl cellosolve, dimethylformamide or ethyl acetate. The water content of the solvent is more preferably 50 mass % or higher, and further preferably 70 mass % or higher.

Specific examples of the preferred solvent composition (number in mass %) include water=100, water/methyl alcohol=90/10, water/methyl alcohol=70/30, water/methyl alcohol/dimethylformamide=80/15/5, water/methyl alcohol/ethyl cellosolve=85/10/5, and water/methyl alcohol/isopropyl alcohol=85/10/5.

1-7. Antifogging Agent

In the invention, a compound represented by a following general formula (H) is preferably included as an antifogging agent;

$$Q—(Y)n—C(Z_1)(Z_2)X \qquad \text{General formula (H):}$$

In the general formula (H), Q represents an alkyl group, an aryl group or a heterocyclic group; Y represents a divalent connecting group; n represents 0 or 1; $Z_1$ and $Z_2$ each represents a halogen atom; and X represents a hydrogen atom or an electron attracting group.

Q preferably represents a phenyl group substituted with an electron attracting group of which a Hammett's substituent constant σp assumes a positive value. As to the Hammett's substituent constant, reference may be made for example to Journal of Medicinal Chemistry, 1973, Vol. 16, No. 11, 1207-1216.

Such electron attracting group can be, for example, a halogen atom (such as fluorine atom (σp: 0.06), chlorine atom (σp: 0.23), bromine atom (σp: 0.23) or iodine atom (σp: 0.18)), a trihalomethyl group (such as tribromomethyl (σp: 0.29), trichloromethyl (σp: 0.33) or trifluoromethyl (σp: 0.54)), a cyano group (σp: 0.66), a nitro group (σp: 0.78), an aliphatic, aryl or heterocyclic sulfonyl group (such as methanesulfonyl (σp: 0.72)), an aliphatic, aryl or heterocyclic acyl group (such as acetyl (σp: 0.50) or benzoyl (σp: 0.43)), an alkynyl group (such as C≡CH (σp: 0.23)), an aliphatic, aryl or heterocyclic oxycarbonyl group (such as methoxycarbonyl (σp: 0.45) or phenoxycarbonyl (σp: 0.44)), a carbamoyl group (σp: 0.36), a sulfamoyl group (σp: 0.57), a sulfoxide group, a heterocyclic group or a phosphoryl group.

The σp value is preferably within a range of 0.2 to 2.0, more preferably 0.4 to 1.0.

The electron attracting group is preferably a carbamoyl group, an alkoxycarbonyl group, an alkylsulfonyl group, an alkylphosphoryl group, a carboxyl group, an alkyl- or arylcarbonyl group, or an arylsulfonyl group, particularly preferably a carbamoyl group, an alkoxycarbonyl group, an alkylsulfonyl group or an alkylphosphoryl group, and most preferably is a carbamoyl group.

X is preferably an electron attracting group, more preferably a halogen atom, an aliphatic, aryl or heterocyclic sulfonyl group, an aliphatic, aryl or heterocyclic acyl group, an aliphatic, aryl or heterocyclic oxycarbonyl group, a carbamoyl group or a sulfamoyl group, and particularly preferably a halogen atom.

The halogen atom is preferably a chlorine atom, a bromine atom or an iodine atom, further preferably a chlorine atom or a bromine atom and particularly preferably a bromine atom.

Y preferably represents —C(=O)—, —SO— or —$SO_2$—, more preferably —C(=O)— or —$SO_2$—, and particularly preferably —$SO_2$—. n represents 0 or 1, preferably 1.

In the following, specific examples of the compound of the general formula (H) are shown, but the invention is not limited to such examples.

(H-1)

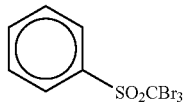

(H-2)

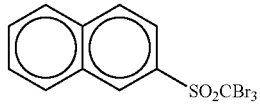

(H-3)

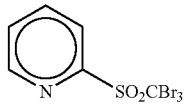

(H-4)

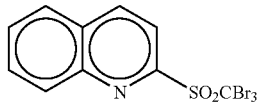

(H-5)

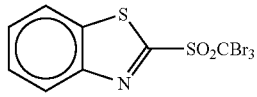

(H-6)

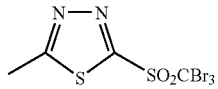

(H-7)

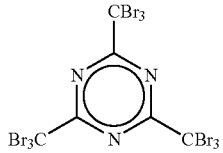

(H-8)

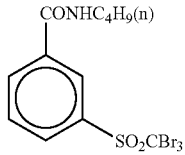

-continued
(H-9)
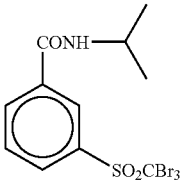
(H-10)
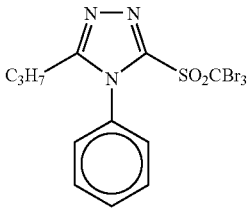
(H-11)
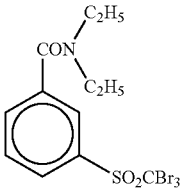
(H-12)
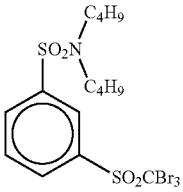
(H-13)
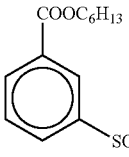
(H-14)
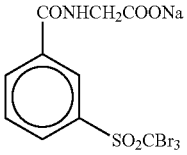
(H-15)
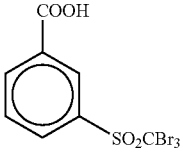
-continued
(H-16)
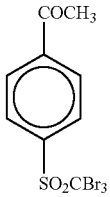
(H-17)
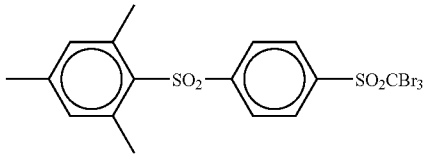
(H-18)
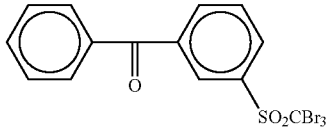
(H-19)
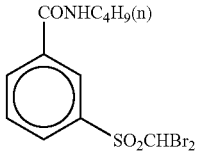
(H-20)
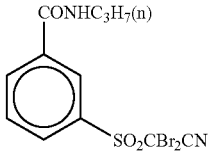
(H-21)
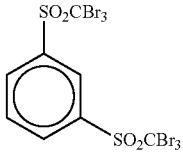
(H-22)
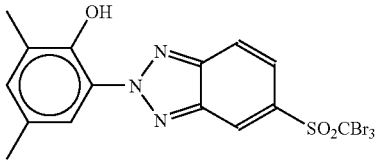
(H-23)
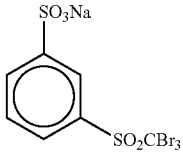

-continued (H-24)

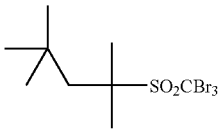

The compound of the general formula (H) of the invention is preferably used in an amount of $10^{-4}$ to 0.8 mol per 1 mol of the non-photosensitive silver salt in the image forming layer, more preferably $10^{-3}$ to 0.1 mol, and further preferably $5\times10^{-3}$ to 0.05 mol.

In the invention, the compound represented by the general formula (H) can be added in the photosensitive material by the aforementioned method described for adding the reducing agent.

The compound represented by the general formula (H) preferably has a melting point of 200° C. or lower, more preferably 170° C. or lower.

Another organic polyhalogenide applicable to the invention can be those disclosed in JP-A No. 11-65021, paragraphs 0111 to 0112. There are particularly preferred an organic halogen compound represented by a formula (P) in JP-A No. 2000-284399, an organic polyhalogen compound represented by a general formula (II) in JP-A No. 10-339934, and an organic polyhalogen compound described in JP-A No. 2001-033911.

1-8. Other Anti-fogging Agents

As another anti-fogging agent, there may be employed a mercury(II) salt described in JP-A No. 11-65021, paragraph 0113, a benzoic acid described therein, paragraph 0114, a salicylic acid derivative described in JP-A No. 2000-206642, a formalin scavenger compound represented by a formula (S) in JP-A No. 2000-221634, a triazine compound described in claim 9 of JP-A No. 11-352624, a compound represented by a general formula (III) in JP-A No. 6-11791, 4-hydroxy-6-methyl-1,3,3a,7-tetrazaindene etc.

An antifogging agent, a stabilizer and a precursor for the stabilizer, which can be used in the invention, can be the compounds described in JP-A No. 10-62899, paragraph 0070, in EP-A No. 0803764A1, page 20, line 57 to page 21, line 7, and in JP-A Nos. 9-281637 and 9-329864.

The photothermographic material of the invention may include an azolium salt for the purpose of fog prevention. The azolium salt can be a compound represented by a general formula (XI) in JP-A No. 59-193447, a compound described in JP-B) No. 55-12581, or a compound represented by a general formula (II) in JP-A No. 60-153039. The azolium salt may be added to any part of the photosensitive material, but, as to a layer of addition, it is preferably added in a layer on a side having the photosensitive layer and more preferably added to the organic silver salt containing layer.

The azolium salt may be added in any step of preparation of the coating solution, and, in the case of an addition to the organic silver salt containing layer, in any step from the preparation of the organic silver salt to the preparation of the coating solution, but preferably within a period from a time after the preparation of the organic silver salt to a time immediately before the coating. The azolium salt may be added in any method, such as powder, a solution or a dispersion of fine particles. Also it may be added as a mixed solution with another additive such as a sensitizing dye, a reducing agent or a toning agent.

In the invention, the azolium salt may be added in any amount, but there is preferred an amount from $1\times10^{-6}$ to 2 mol per 1 mol of silver, more preferably from $1\times10^{-3}$ to 0.5 mol.

1-9. Other Additives

1) Mercapto, Disulfide and Thion

In the invention, for the purposes of controlling development by suppression or acceleration, improving an efficiency of spectral sensitization, improving preservability before and after the development etc., there may be included a mercapto compound, a disulfide compound or a thion compound such as those described in JP-A No. 10-62899, paragraphs 0067-0069, those represented by a general formula (I) in JP-A No. 10-186572 and specific example described in paragraphs 0033-0052 thereof, and those described in EP-A No. 0803764A1, page 20, lines 36-56 and JP-A No. 11-273670. Among these, particularly preferred is a mercapto-substituted heteroaromatic compound.

2) Toning Agent

In the photothermographic material of the invention, a toning agent is preferably added. The toning agent is described in JP-A No. 10-62899, paragraphs 0054-0055, European Patent No. 0803764A1, p.21, lines 23 to 48, JP-A No. 2000-356317 and Japanese Patent Application No. 2000-187298, and there is preferred a phthalazinone (phthalazinone, a phthalazinone derivative or a metal salt thereof, such as 4-(1-naphthyl)phthalazinone, 6-chlorophthalazinone, 5,7-dimethoxyphthazinone or 2,3-dihydro-1,4-phthalazinedione); a combination of a phthalazinone and a phthalic acid (such as phthalic acid, 4-methylphthalic acid, 4-nitrophthalic acid, diammonium phthalate, sodium phthalate, potassium phthalate or tetrachlorophthalic anhydride); or a phthalazine (phthalazine, a phthalazine derivative or a metal salt thereof, such as 4-(1-naphtyl)phthalazine, 6-isopropylphthalazine, 6-t-butylphthalazine, 6-chlorophthalazine, 5,7-dimethoxyphthalazine or 2,3-dihydrophthalazine), and, particularly in a combination with silver halide having a high silver iodide content, there is preferred a combination of a phthalazine and a phthalic acid.

An addition amount of the phthalazine is preferably 0.01 to 0.3 mol per 1 mol of the organic silver salt, more preferably 0.02 to 0.2 mol and particularly preferably 0.02 to 0.1 mol. This amount of addition is an important factor for development acceleration which is an issue in the silver halide emulsion of the invention having a high silver iodide content, and a sufficient developing property and a low fog level are achieved compatibly by the selection of an appropriate amount of addition.

3) Plasticizer, Lubricant

A plasticizer and a lubricant applicable to the photosensitive layer of the invention are described in JP-A No. 11-65021, paragraph 0117. Also a sliding agent is described in JP-A No. 11-84573, paragraphs 0061-0064 and JP-A No. 2001-83679, paragraphs 0049-0062.

4) Dye, Pigment

In the photosensitive layer of the invention, for the purposes of tone improvement, prevention of interference fringes at the laser exposure and prevention of irradiation, there may be used various dyes and pigments (for example C. I. Pigment Blue 60, C. I. Pigment Blue 64, or C. I. Pigment Blue 15:6). These are described in detail for example in WO98/36322, and JP-A Nos. 10-268465 and 11-338098.

5) Ultra High Contrast Agent

For forming an ultra high contrast image suitable for printing plate making, it is preferable to add an ultra high contrast agent into the image forming layer. The ultra high contrast agent, a method of addition thereof and an amount of addition thereof are described for example in JP-A No. 11-65021, paragraph 0118, JP-A No. 11-223898, paragraphs 0136-0193, JP-A No. 11-87297, formulae (H), (1) to (3), (A) and (B), and JP-A No. 11-91652, general formulae (III) to (V) (specific compounds being shown in chemical formulae 21-24), and a high contrast promoting agent is described in JP-A No. 11-65021, paragraph 0102 and JP-A No. 11-223898, paragraphs 0194-0195.

In order to employ formic acid or a formate salt as a strong fogging substance, it is preferably added in a side having the image forming layer, containing photosensitive silver halide, in an amount of 5 mmol or less per 1 mol of silver, more preferably 1 mmol or less.

In the case of employing an ultra high contrast agent in the photothermographic material of the invention, it is preferable to use, in combination, an acid formed by hydration of phosphorous pentoxide or a salt thereof. Examples of the acid formed by hydration of phosphorous pentoxide or a salt thereof include metaphosphoric acid (and salt thereof, pyrophosphoric acid (and salt thereof, orthophosphoric acid (and salt thereof, triphosphoric acid (and salt thereof, tetraphosphoric acid (and salt thereof, and hexametaphosphoric acid (and salt thereof. An acid formed by hydration of phosphorous pentoxide or a salt thereof, that can be particularly preferably employed, can be orthophosphoric acid (or salt thereof), or hexametaphosphoric acid (or salt thereof). Specific examples of salt include sodium orthophosphate, sodium dihydrogen orthophosphate, sodium hexametaphosphate and ammonium hexametaphosphate.

An amount of use (coating amount per 1 $m^2$ of the photosensitive material) of the acid formed by hydration of phosphorous pentoxide or the salt thereof may be suitably selected according to the desired performances such as the sensitivity or the fog level, but is preferably 0.1 to 500 $mg/M^2$ and more preferably 0.5 to 100 $mg/m^2$.

1-10. Preparation and Coating of Coating Solution

A coating solution for the image forming layer of the invention is preferably prepared at a temperature from 30° C. to 65° C., preferably at a temperature equal to or higher than 35° C. but less than 60° C., more preferably a temperature from 35° C. to 55° C. Also the coating solution for the image forming layer is preferably maintained, immediately after the addition of polymer latex, at a temperature from 30° C. to 65° C.

2. OTHER LAYERS AND COMPONENTS THEREOF

The photothermographic material of the invention may have a non-photosensitive layer in addition to the image forming layer. The non-photosensitive layer can be classified, based on a position thereof, into (a) a surface protective layer provided on the image forming layer (namely farther from the substrate), (b) an intermediate layer provided between plural image forming layers or between an image forming layer and a protective layer, (c) an undercoat layer formed between an image forming layer and the substrate, and (d) a back layer formed on the side opposite to the image forming layer.

There may also be provided a layer functioning as an optical filter, which is formed as a layer (a) or (b). Also an antihalation layer is provided as a layer (c) or (d) in the photosensitive material.

1) Surface Protective Layer

The photothermographic material of the invention may have a surface protective layer, for example for preventing sticking of the image forming layer. Single surface protective layer may be provided or plural surface protective layers may be provided. The surface protective layer is described in JP-A No. 11-65021, paragraphs 0119-0120 and JP-A No. 2001-348546.

As a binder for the surface protective layer of the invention, gelatin is preferred, but it is also preferable to use polyvinyl alcohol (PVA) singly or in combination with gelatin. For the gelatin, there can be used inert gelatin (for example Nitta gelatin 750) or phthalized gelatin (for example Nitta gelatin 801).

As PVA, there can be used one described in JP-A No. 2000-171936, paragraphs 0009-0020, and there can be preferably used a completely saponified product such as PVA-105, a partially saponified product such as PV-205, PVA-335, or a modified polyvinyl alcohol such as MP-203 (foregoing being trade names of Kuraray Co.).

A coating amount of polyvinyl alcohol (per 1 $m^2$ of substrate) in the protective layer (per one layer) is preferably 0.3 to 4.0 $g/m^2$, more preferably 0.3 to 2.0 $g/m^2$.

A coating amount (per 1 $m^2$ of substrate) of the total binder (including water-soluble polymer and latex polymer) in the surface protective layer (per one layer) is preferably 0.3 to 5.0 $g/m^2$, more preferably 0.3 to 2.0 $g/m^2$.

2) Antihalation Layer

In the photothermographic material of the invention, an antihalation layer may be provided at a side of the photosensitive layer farther than the photosensitive layer from the exposure light source. The antihalation layer is described for example in JP-A No. 11-65021, paragraphs 0123-0124, JP-A Nos. 11-223898, 9-230531, 10-36695, 10-104779, 11-231457, 11-352625 and 11-352626.

The antihalation layer includes an antihalation dye having an absorption in the exposure wavelength. In the case the exposure wavelength is in an infrared region, there can be employed an infrared-absorbing dye, and, in such case, there is preferred a dye which has no absorption in the visible region.

In the case of preventing halation with a dye having an absorption in the visible region, it is preferred that the color of the dye does not substantially remain after the image formation. It is preferable to employ means of decoloring by the heat at the thermal development, and particularly preferable to add a thermally decolorable dye and a base precursor in the non-photosensitive layer thereby achieving a function as an antihalation layer. Such technology is described for example in JP-A No. 11-231457.

An addition amount of the decolorable dye is determined according to the purpose of the dye. In general it is used in such an amount that the optical density (absorbance) measured at a desired wavelength is higher than 0.1. The optical density is preferably within a range from 0.2 to 2. An amount of use of the dye for obtaining such optical density is generally within a range of about 0.001 to 1 $g/m^2$.

By decoloring the dye, it is possible to reduce the optical density after thermal development to 0.1 or less. It is also possible to use two or more decolorable dyes in combination, in a thermally decoloring recording material or a photothermographic material. Similarly, it is possible to use two or more base precursors in combination.

In such thermal decoloring utilizing a thermally decolorable dye and a base precursor, it is preferable, for the thermal decoloring property, to use in combination a substance (such as diphenylsulfon, or 4-chlorophenyl(phenyl)sulfon) that can lower the melting point by 3° C. or more when mixed with the base precursor, as described in JP-A No. 11-352626.

3) Back Layer

A back layer that can be used in the invention is described in JP-A No. 11-65021, paragraphs 0128-0130.

In the invention, a coloring agent having an absorption maximum at 300 to 450 nm may be added in order to improve a tone of silver image and a change of the image with time passing. Such coloring agent is described for example in JP-A Nos. 62-210458, 63-104046, 63-103235, 63-208846, 63-306436, 63-314535 and 01-61745 and JP-A No. 2001-100363. Such coloring agent is added usually in an amount of 0.1 mg/m$^2$ to 1 g/m$^2$, and preferably added in a back layer formed on the opposite side of the photosensitive layer.

4) Matting Agent

In the invention, it is preferable to add a matting agent in the surface protective layer and in the back layer, for improving a transporting property. The matting agent is described in JP-A No. 11-65021, paragraphs 0126-0127.

A coating amount of the matting agent per 1 m$^2$ of the photosensitive material is preferably 1 to 400 mg/m$^2$, more preferably 5 to 300 mg/m$^2$.

A matting degree of an emulsion surface may be arbitrarily selected so long as so-called stardust failure, showing a small white spot in an image area and causing a light leakage, does not occur. And the matting degree is preferably within a range of Beck's smoothness of 30 to 2000 seconds, particularly preferably 40 to 1500 seconds. The Beck's smoothness can be easily determined by JIS P8119 "Smoothness testing method with Beck's tester for paper and board", and TAPPI standard method T479.

In the invention, a matting degree of the back layer is preferably within a range of Beck's smoothness of 1200 to 10 seconds, more preferably 800 to 20 seconds and further preferably 500 to 40 seconds.

In the invention, the matting agent is preferably included in an outermost surface layer of the photosensitive material, a layer functioning as an outermost surface layer, or a layer close to the external surface. It is preferably included in a layer functioning as a protective layer.

5) Polymer Latex

A polymer latex may be added in the surface protective layer or the back layer of the invention. Such polymer latex is described for example in *Gosei Jushi Emulsion* (Synthetic resin emulsion) (edited by Taira Okuda and Hiroshi Inagaki, published by Kobunshi Kankokai (1978)), *Gosei Latex no ouyou*, (Application of synthetic latex) (edited by Takaaki Sugimura, Yasuo Kataoka, Soichi Suzuki and Keiji Kasahara, published by Kobunshi Kankokai (1993)), and *Gosei Latex no Kagaku* (Chemistry of synthetic latex) (Soichi Muroi, published by Kobunshi Kankokai (1970)), and can more specifically be a latex of a methyl methacrylate (33.5 mass %)/ethyl acrylate (50 mass %)/methacrylic acid (16.5 mass %) copolymer, a latex of a methyl methacrylate (47.5 mass %)/butadiene (47.5 mass %)/itaconic acid (5 mass %) copolymer, a latex of an ethyl acrylate/methacrylic acid copolymer, a latex of a methyl methacrylate (58.9 mass %)/2-ethylhexyl acrylate (25.4 mass %)/styrene (8.6 mass %)/2-hydroxyethyl methacrylate (5.1 mass %)/acrylic acid (2.0 mass %) copolymer, a latex of a methyl methacrylate (64.0 mass %)/styrene (9.0 mass %)/butyl acrylate (20.0 mass %)/2-hydroxyethyl methacrylate (5.0 mass %)/acrylic acid (2.0 mass %) copolymer etc.

The mass of the polymer latex is preferably occupies 10 to 90 mass % of the mass of the total binder (including water-soluble polymer and latex polymer) in the surface protective layer or the back layer, particularly preferably 20 to 80 mass %.

6) Film surface pH

The photothermographic material of the invention preferably has a film surface pH of 7.0 or less before the thermal development, more preferably 6.6 or less. A lower limit of the film surface pH is not particularly restricted but is generally about 3. A most preferred pH range is from 4 to 6.2.

For regulating the film surface pH, there is preferably used an organic acid such as a phthalic acid derivative, a non-volatile acid such as sulfuric acid, or a volatile base such as ammonia, in view of lowering the film surface pH. In particular, ammonia is preferred for attaining a low film surface pH, as it is easily volatile and can be removed in the coating step or before the thermal development.

It is also preferable to employ a non-volatile base such as sodium hydroxide, potassium hydroxide or lithium hydroxide in combination with ammonia. A measuring method for the film surface pH is described in JP-A No. 2000-284399, paragraph 0123.

7) Hardening Agent

A hardening agent may be used in the photosensitive layer, the protective layer, or the back layer of the invention.

Examples of the hardening agent are described in T. H. James, "The Theory of the Photographic Process Fourth Edition" (Macmillan Publishing Co. Inc., 1977) pp. 77-87, and there can be preferably used chromium alum, sodium 2,4-dichloro-6-hydroxy-s-triazine, N,N-ethylenebis(vinylsulfonacetamide), N,N-propylenebis(vinylsulfonacetamide), a polyvalent metal ion described in p. 78 of the aforementioned reference, a polyisocyanate described in U.S. Pat. No. 4,281,060, JP-A No. 6-208193, etc., an epoxy compound described in U.S. Pat. No. 4,791,042 etc. and a vinylsulfone compound described in JP-A No. 62-89048 etc.

The hardening agent is added as a solution, and a timing of addition of such solution to the coating solution for the protective layer is within a period from 180 minutes before the coating operation to a time immediately before the coating operation, preferably within a period from 60 minutes before the coating operation to 10 seconds before the coating operation, but a mixing method and a mixing condition are not particularly restricted as long as the effect of the invention can be sufficiently exhibited.

Specific examples of the mixing method include a mixing method in a tank for obtaining a desired average stay time based on an addition flow rate and a liquid supply rate to a coater, and a method of utilizing a static mixer, as described in N. Harnby, M. F. Edwards, A. W. Nienow, "Ekitai Kongou Gijutsu" (Liquid Mixing Technologies) (translated by Koji Takahashi, Nikkan Kogyo Shimbunsha, 1989), chapter 8.

8) Surfactant

A surfactant applicable to the invention is described in JP-A No. 11-65021, paragraph 0132.

In the invention, it is preferred to use a fluorine type surfactant. Preferred specific examples of the fluorine type surfactant include the compounds described in JP-A Nos. 10-197985, 2000-19680 and 2000-214554. There can also be preferably used a fluorinated polymer surfactant described in JP-A No. 9-281636. In the invention, it is particularly preferred to employ a fluorine type surfactant described in JP-A No. 2002-017452.

9) Antistatic Agent

In the invention, there may also be provided an antistatic layer including a known metal oxide or a conductive polymer. The antistatic layer may also serve as the undercoat layer, the back layer or the surface protective layer mentioned in the foregoing, or may be formed separately. For the antistatic layer, there may be applied technologies described in JP-A No. 11-65021, paragraph 0135, JP-A Nos. 56-143430, 56-143431, 58-62646 and 56-120519, JP-A No. 11-84573, paragraphs 0040-0051, U.S. Pat. No. 5,575,957 and JP-A No. 11-223898, paragraphs 0078-0084.

10) Substrate

For a transparent substrate, there is preferably employed a polyester, particularly polyethylene terephthalate, subjected to a heat treatment in a temperature range of 130 to 185° C. in order to relax an internal strain remaining in the film at a biaxial drawing thereby eliminating a thermal shrinking strain generated at the thermal development.

In the case of a photothermographic material for medical use, the transparent substrate may be colored with a blue dye (for example a dye 1 described in examples of JP-A No. 8-240877), or may be colorless.

Specific examples of the substrate are described in JP-A No. 11-65021, paragraph 0134.

For the substrate, there is preferably applied an undercoating process for example with a water-soluble polyester described in JP-A No. 11-84574, a styrene-butadiene copolymer described in JP-A No. 10-186565, a vinylidene chloride copolymer described in JP-A No. 2000-39684 and JP-A No. 2001-83679, paragraphs 0063-0080.

11) Other Additives

In the photothermographic material, there may be further added an antioxidant, a stabilizer, a plasticizer, an ultraviolet absorber and an coating assistant. Also a solvent described in JP-A No. 11-65021, paragraph 0133 may be added. These additives are added either in the photosensitive layer or in the non-photosensitive layer. For these, reference may be made for example to WO No. 98/36322, EP No. 803764A1, JP-A Nos. 10-186567 and 10-18568.

12) Coating Method

The photothermographic material of the invention may be coated by any coating method. More specifically, there can be applied various coating methods including extrusion coating, slide coating, curtain coating, dip coating, knife coating, flow coating and extrusion coating utilizing a hopper of a kind described in U.S. Pat. No. 2,681,294, and there is preferably employed extrusion coating described in Stephen F. Kistler and Petert M. Schweizer, "Liquid Film Coating" (Chapman & Hall, 1997), pp. 399-536, or slide coating, and particularly preferably slide coating.

An example of a shape of a slide coater to be used in the slide coating is shown in FIG. 11b.1 in the above-mentioned reference, p. 427. Also, if desired, two or more layers can be simultaneously applied by a method described in the above-mentioned reference, pp. 399-536, or methods described in U.S. Pat. No. 2,761,791 and BP No. 837,095.

The coating solution for the organic silver salt-containing layer of the invention is preferably so-called thixotropic fluid. For such technology, reference may be made to JP-A No. 11-52509.

The coating solution for the organic silver salt-containing layer of the invention preferably has a viscosity at a shear speed of 0.1 $S^{-1}$ within a range from 400 to 100,000 mPa·s, and more preferably 500 to 20,000 mPa·s.

Also a viscosity at a shear speed of 1000 $S^{-1}$ is preferably within a range from 1 to 200 mPa·s, and more preferably 5 to 80 mPa·s.

13) Packaging Material

The photothermographic material of the invention is preferably packaged with tight sealing by a packaging material of a low oxygen permeability and/or a low moisture permeability, in order to avoid an alteration of the photographic performance during storage before use, or to prevent a curling or a winding in the case of a rolled product. The oxygen permeability at 25° C. is preferably 50 ml/atm/$m^2$·day or less, more preferably 10 ml/atm/$m^2$·day or less, and further preferably 1.0 ml/atm/$m^2$ day or less. The moisture permeability is preferably 10 g/atm/$m^2$·Day or less, more preferably 5 g/atm/$m^2$·day or less, and further preferably 1 g/atm/$m^2$·day or less. Specific examples of the packaging material of a low oxygen permeability and/or a low moisture permeability include those described in JP-A Nos. 8-254793 and 2000-206653.

14) Other Applicable Technologies

In the photothermographic material of the invention, other technologies are also applicable, such as those described in EP No. 803764A1, EP No. 883022A1, WO No. 98/36322, JP-A Nos. 56-62648, 58-62644, 9-43766, 9-281637, 9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987,10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629,11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2001-200414, 2001-234635, 2002-020699, 2001-275471, 2001-275461, 2000-313204, 2001-292844, 2000-324888, 2001-293864, and 2001-348546 Japanese Patent Applications No. 2000-187298.

15) Color Image Formation

In the case of a multi-color photothermographic material, the emulsion layers are maintained in a mutually separated manner, as described in U.S. Pat. No. 4,460,681, by employing a functional or non-functional barrier layer between the photosensitive layers.

In a multi-color photothermographic material, a combination of these two layers may be included for each color, or all the components may be included in a single layer as described in U.S. Pat. No. 4,708,928.

3. IMAGE FORMING METHOD

3-1. Exposure

The photosensitive material of the invention may be exposed by any method, but a laser light is preferred as an exposure light source.

Particularly in the case of giving an exposure amount providing a maximum density (Dmax), an amount of light on the surface of the photosensitive material is preferably 0.1 to 100 W/$mm^2$, more preferably 0.5 to 50 W/$mm^2$, and most preferably 1 to 50 W/$mm^2$.

For the laser light in the invention, there is preferably employed a gas laser ($Ar^+$, He—Ne, He—Cd), a YAG laser, a dye laser, or a semiconductor laser. It is also possible to use a semiconductor laser and a second harmonic generating device. A preferably employed laser is determined according to an optical absorption peak wavelength of a spectral sensitizing dye etc. in the photothermographic material, but is a He—Ne laser emitting red to infrared light, a semiconductor laser emitting red light, an $Ar^+$, He—Ne or He—Cd laser emitting blue to green light, or a semiconductor laser emitting blue light. Recently a laser output apparatus of a short wavelength region is attracting particular attention, with the development of a module integrating an SHG (second harmonic generator) device and a semiconductor laser, and of a blue light-emitting semiconductor laser. Demand for the blue light-emitting semiconductor laser is anticipated to increase hereafter, since such laser is capable of recording of a high-definition image, achieving an increase in the recording density and providing a stable output with a long service life.

A laser light oscillated in a vertical multi mode for example by a high frequency superposing method can also be employed advantageously.

3-2. Thermal Development

The photothermographic material of the invention may be developed in any method, but the development is usually executed by elevating the temperature of the photothermographic material which has been exposed imagewise. A developing temperature is preferably 80 to 250° C., more preferably 100 to 140° C.

A developing time is preferably 1 to 60 seconds, more preferably 5 to 30 seconds and particularly preferably 5 to 20 seconds.

For thermal development, a plate heater method is preferred. For thermal development with a plate heater method there is preferred a method described in JP-A No. 11-133572, employing a thermal development apparatus which contacts a photothermographic material containing a latent image with heating means in a thermal development unit thereby obtaining a visible image, wherein the heating means is constituted by a plate heater, while plural pressing rollers are positioned along one surface of the plate heater, and the photothermographic material is passed between the pressing rollers and the plate heater to execute thermal development. It is preferred to divide the plate heater into 2 to 6 stages and to lower the temperature by 1 to 10° C. in a leading end portion.

Such method, described also in JP-A No. 54-30032, allows to remove moisture or organic solvent, contained in the photothermographic material, from the system, and to suppress a change in the shape of the substrate of the photothermographic material caused by a rapid heating thereof.

3-3. System

An example of a laser imager system for medical use, having an exposure unit and a thermal development unit, is Fuji Medical Dry Imager FM-DPL. This system is described in Fuji Medical Review No. 8, p. 39-55, and there can be utilized such described technology. Also a photothermographic material recited in the invention can be utilized as a photothermographic material for a laser imager in an AD Network, proposed by Fuji Medical Co. as a network system satisfying the DICOM standard.

4. APPLICATION OF INVENTION

The photothermographic material of the invention forms a black-and-white image by a silver image, and is preferably utilized as a photothermographic material for medical diagnosis, a photothermographic material for industrial photography, a photothermographic material for printing and a photothermographic material for COM.

EXAMPLES

In the following, the present invention will be further clarified by examples thereof, but the invention is not limited by such examples.

Example 1

1. Preparation of PET Substrate and Undercoating

1) Film Formation

Using terephthalic acid and ethylene glycol, and following an ordinary method, a PET of an intrinsic viscosity IV=0.66 (measured at 25° C., phenol/tetrachloroethane=6/4) was obtained. It was pelletized, then dried for 4 hours at 130° C., and fused at 300° C. Then it was extruded from a T-die and cooled rapidly to obtain an unextended film having a film thickness of 175 μm after thermal fixation.

The film was then extended 3.3 times in the machine direction with rollers having different peripheral speeds, and extended 4.5 times in the transversal direction with a tenter. The temperature was 110° C. and 130° C., respectively. Then, after a thermal fixation for 20 seconds at 240° C., a relaxation of 4% in the transversal direction was executed at the same temperature. Then, after portions chucked by the tenter were slit off, knurling was applied to both ends, and the film was wound under a tension of 4 kg/cm$^2$ to obtain a roll of a film having a thickness of 175 μm.

2) Surface Treatment with Corona Discharge

A solid-state corona discharge treating apparatus model 6 KVA, manufactured by Pillar Inc., was employed to treat both sides of the substrate at a speed of 20 m/min. Based on current and voltage values read in this operation, it was identified that the substrate was treated under a condition of 0.375 kV·A·min/m$^2$. In this treatment, a frequency was 9.6 kHz and a gap clearance between an electrode and a dielectric roll was 1.6 mm.

3) Undercoating 3-1) Preparation of Coating Solution for Undercoat Layer Formulaion (1) (for Undercoat Layer at the Side of Photosensitive Layer)

| | |
|---|---|
| Pesresin A-520 (30 mass % solution) (manufactured by Takamatsu Yushi Co.) | 59 g |
| polyethylene glycol monononylphenyl ether (average number of ethylene oxide = 8.5), 10 mass % solution | 5.4 g |
| MP-1000 (polymer particles, average particle size 0.4 μm) (manufactured by Soken Kagaku Co.) | 0.91 g |
| distilled water | 935 ml |
| Formulation (2) (for first layer on back side) | |
| styrene-butadiene copolymer latex (solid 40 mass %, styrene/butadiene weight ratio = 68/32) | 158 g |
| 2,4-dichloro-6-hydroxy-S-triazine sodium salt, 8 mass % aqueous solution | 20 g |
| sodium laurylbenzenesulfonate, 1 mass % aqueous solution | 10 ml |
| distilled water | 854 ml |
| Formulation (3) (for second layer on back side) | |
| $SnO_2$/SbO (mass ratio 9/1, average particle size | 84 g |

-continued

| | |
|---|---|
| 0.038 μm, 17 mass % dispersion) | |
| gelatin (10 mass % aqueous solution) | 89.2 g |
| Metolose TC-5 (2 mass % aqueous solution) (manufactured by Shin-etsu Chemical Ltd.) | 8.6 g |
| MP-1000 (manufactured by Soken Kagaku Co.) | 0.01 g |
| sodium dodecylbenzenesulfonate, 1 mass % aqueous solution | 10 ml |
| NaOH (1 mass %) | 6 ml |
| Proxel (manufactured by ICI Ltd.) | 1 ml |
| distilled water | 805 ml |

3-2 Undercoating

Both sides of the aforementioned biaxially extended polyethylene terephthalate substrate having a thickness of 175 μm was subjected to the aforementioned corona discharge treatment, then the aforementioned undercoating formulation (1) was coated on a side (at the side of the photosensitive layer) by a wire bar to give a wet coating amount of 6.6 ml/m$^2$ (per one side) and dried for 5 minutes at 180° C. Then the aforementioned undercoating formulation (2) was coated on the rear side (back surface) by a wire bar to give a wet coating amount of 5.7 ml/m$^2$ and dried for 5 minutes at 180° C., and the aforementioned undercoating formulation (3) was coated on the rear side (back surface) by a wire bar to give a wet coating amount of 7.7 ml/m$^2$ and dried for 6 minutes at 180° C. to obtain an undercoated substrate.

2. Back Layer 2-1. Preparation of Coating Solutions for Back Layer

1) Preparation of Dispersion (a) of Solid Fine Particles of Base Precursor 1.5 kg of base precursor compound I, 225 g of Demol N (trade name, Kao Ltd.), 937.5 g of diphenylsulfone, 15 g of parahydroxybenzoic acid methyl ester (trade name: Mekkins M, Ueno Seiyaku Co.) and distilled water to make a total amount of 5.0 kg were mixed, and the mixture was dispersed by a horizontal sand mill (trade name: UVM-2, Imex Co.). The dispersion was conducted under conditions of feeding the mixture by a diaphragm pump to the UVM-2 sand mill charged with zirconia beads having an average diameter of 0.5 mm and continuing dispersion until a desired dispersion level was obtained with an internal pressure of 50 hPa or higher. The dispersion level was judged by a ratio of absorbances at 450 nm and 650 nm (D450/D650) obtained by measuring the spectral absorbance of the dispersion, and the dispersion was conducted until such ratio became 2.2 or higher. After the dispersion, it was diluted with distilled water so as to obtain a concentration of the base precursor of 20 wt. % and was filtered with a polypropylene filter (average pore size: 3 μm) for removing dusts.

2) Preparation of Dispersion (a) of Solid Dye Particles 6.0 kg of a cyanine dye compound-1, 3.0 kg of sodium p-dodecylbenzenesulfonate, 0.6 kg of Demol SMB (trade name, Kao Ltd.), 0.15 kg of Surfinol 104E (trade name, Nisshin Kagaku Co.) and distilled water were mixed to obtain a total amount of 60 kg. The mixture was dispersed in a horizontal sand mill UVM-2 utilizing zirconia beads having an average diameter of 0.5 mm. The dispersion was conducted until the absorbance ratio (D650/D750) reached 5.0 or higher. After the dispersion, the resultant dispersion was diluted with distilled water so as to obtain a concentration of the cyanine dye of 6 wt. % and was filtered with a polypropylene filter (average pore size: 1 μm) for removing dusts.

3) Preparation of Coating Solution for Antihalation Layer 30 g of gelatin, 24.5 g of polyacrylamide, 2.2 g of sodium hydroxide at a concentration of 1 mol/L, 2.4 g of fine particles of mono-dispersion polymethyl methacrylate (average particle size 8 μm, standard deviation of particle diameter 0.4), 0.08 g of benzoisothiazolinone, 35.9 g of the aforementioned solid dye particle dispersion (a), 74.2 g of the aforementioned base precursor solid particle dispersion (a), 0.6 g of sodium polyethylenesulfonate, 0.21 g of a blue dye compound-1,0.15 g of a yellow dye compound-1, 8.3 g of an acrylic acid/ethyl acrylate copolymer latex (copolymerization ratio: 5/95) and water were mixed to give a total amount of 818 mL and a coating solution for the antihalation layer was obtained.

4) Preparation of Coating Solution for Back Surface Protective Layer

A container was maintained at 40° C., and 40 g of gelatin, a liquid paraffin emulsion containing 1.5 g of liquid paraffin, 35 mg of benzoisothiazolinone, 6.8 g of sodium hydroxide at a concentration of 1 mol/L, 0.5 g of sodium t-octylphenoxyethoxyethane sulfonate, 0.27 g of sodium polystyrenesulfonate, 2.0 g of N,N-ethylenebis(vinylsulfonacetamide), 37 mg of a fluorine type surfactant (F-1), 150 mg of a fluorine type surfactant (F-2), 64 mg of a fluorine type surfactant (F-3), 32 mg of a fluorine type surfactant (F-4), 6.0 g of acrylic acid/ethyl acrylate copolymer (copolymerization weight ratio 5/95), and water to make a total amount of 1000 ml were mixed to obtain a coating solution for the back surface protective layer.

2-2. Coating of Back Layer

On the rear surface of the aforementioned undercoated substrate, the coating solution for the antihalation layer and the coating solution for the back surface protective layer were coated by a simultaneous multi-layer coating method to give respective gelatin coating amounts of 0.44 and 1.7 g/m$^2$ and dried to obtain a back layers.

3. Image Forming Layer, and Surface Protective Layer 3-1. Preparation of Coating Materials 1) Silver Halide Emulsion (Preparation of Comparative Silver Halide Emulsion a)

Example of Uniform Inclusion of Ir and Cu in Grain

A solution, obtained by adding 3.1 ml of a 1 mass % solution of potassium bromide to 1421 ml of distilled water, and also adding 3.5 ml of sulfuric acid at a concentration of 0.5 mol/L and 31.7 g of phthalized gelatin, was maintained at 27° C. under agitation in a stainless steel reaction pot, and solution A obtained by dissolving 37 g of silver nitrate with distilled water to give an amount of 159 ml and solution B obtained by dissolving 25.5 g of potassium bromide, 1.33 g of potassium iodide, 11.5 mg of potassium hexachloroiridate (III) and 5.5 mg of $Cu(NO_3)_2.2.5\ H_2O$ in distilled water to give an amount of 162 ml were added completely under constant flow rate and over 75 seconds. Then 10 ml of a 3.5 mass % aqueous solution of hydrogen peroxide was added, and 10.8 ml of a 10 mass % aqueous solution of benzimidazole was added. Further, solution C obtained by dissolving 37 g of silver nitrate in distilled water to give an amount of 227 ml was added completely under constant flow rate over 14 minutes, solution D obtained by dissolving 31.6 g of potassium bromide, 1.57 g of potassium iodide, 14.3 mg of potassium hexachloroiridate(III) and 7.1 mg of $Cu(NO_3)_2.2.5\ H_2O$ in distilled water to give an amount of 286 ml was added by a controlled double jet method keeping pAg at 8.1. Then pH was adjusted to 3.8 with sulfuric acid at a concentration of 0.5 mol/L. Then the agitation was terminated and precipitation/desalting/rinsing steps were executed. The pH was adjusted to 5.9 with sodium hydroxide at a concentration of 1 mol/L, thereby obtaining a silver halide dispersion having a pAg value of 8.0. In emulsion grains having a core:shell ratio=1:1, potassium hexachloroiridate(III) and $Cu(NO_3)_2.2.5\ H_2O$ were uniformly doped in the grains at a respective concentration of $1\times10^{-4}$ mol per 1 mol of silver.

The aforementioned silver halide dispersion was maintained at 38° C. under agitation, then 5 ml of 0.34 mass % methanol solution of 1,2-benzoisothiazolin-3-one was added, and the mixture was heated to 47° C. after 40 minutes. At 20 minutes after the temperature elevation, sodium benzenethiosulfonate in a methanol solution was added in an amount of $7.6\times10^{-5}$ mol with respect to 1 mol of silver, then further after 5 minutes, a tellurium sensitizer C in a methanol solution was added in an amount of $2.9\times10^{-4}$ mol with respect to 1 mol of silver, and a ripening was executed for 91 minutes. Thereafter, a spectral sensitizing dye A and a sensitizing dye B in a methanol solution having a molar ratio of 3:1 were added in an amount of $1.2\times10^{-3}$ mol for a sum of the sensitizing dyes A and B with respect to 1 mol of silver, then, after 1 minute, 1.3 ml of a 0.8 mass % methanol solution of N,N'-dihydroxy-N"-diethylmelamine were added, and, after further 4 minutes, 5-methyl-2-mercaptobenzoimidazole in a methanol solution in an amount of $4.8\times10^{-3}$ mol with respect to 1 mol of silver, 1-phenyl-2-heptyl-5-mercapto-1,3,4-triazole in a methanol solution in an amount of $5.4\times10^{-3}$ mol with respect to 1 mol of silver, and sodium 1-(3-methylureide)-5-mercaptotetrazole in an aqueous solution in an amount of $8.5\times10^{-3}$ mol with respect to 1 mol of silver, were added to prepare a silver halide emulsion a.

Thus prepared silver halide emulsion included silver iodobromide grains having an average sphere-corresponding diameter of 0.037 μm and a variation coefficient of the sphere-corresponding diameter of 20% and uniformly containing 3.5 mol % iodine. The grain size etc. were determined from the average of 1000 grains, utilizing an electron microscope. The grains had a [100] plane ratio of 80%, as determined by a Kubelka-Munk method.

(Preparation of Comparative Silver Halide Emulsion b)

*Example of Containing Entire Amounts of Ir and Cu in Shell of 75%

A grain formation was executed in the same manner as in the emulsion a, except that the amounts of silver nitrate and halogen solution in the solutions B to D were so adjusted as to obtain a core:shell ratio=25:75, that potassium hexachloroiridate(III) and $Cu(NO_3)_2.2.5\ H_2O$ were eliminated from the solution B and that 23 mg of potassium hexachloroiridate(III) and 14.3 mg of $Cu(NO_3)_2\ 2.5\ H_2O$ were added to the solution D. In the emulsion grains having a core:shell ratio=25:75, potassium hexachloroiridate(III) was doped in the core portion while $Cu(NO_3)_2.2.5\ H_2O$ was doped in the shell portion of the silver halide grains, with an amount of $1\times10^{-4}$ mol per 1 mol of silver, respectively. Then pH was adjusted to 3.8 with sulfuric acid at a concentration of 0.5 mol/L. Then the agitation was terminated and precipitation/desalting/rinsing steps were executed. The pH was adjusted to 5.9 with sodium hydroxide at a concentration of 1 mol/L, thereby obtaining a silver halide dispersion having a pAg value of 8.0. Thereafter a chemical ripening was executed as in the emulsion a, thereby preparing a silver halide emulsion b.

Thus prepared silver halide emulsion included silver iodobromide grains having an average sphere-corresponding diameter of 0.037 μm and a variation coefficient of the sphere-corresponding diameter of 20% and uniformly containing 3.5 mol % iodine. The grain size etc. were determined from the average of 1000 grains, utilizing an electron microscope. The grains had a [100] plane ratio of 80%, as determined by a Kubelka-Munk method.

(Preparation of Silver Halide Emulsion 1 of the Invention)

*Example of Containing 90% Ir in Core of 50% and Cu in Shell

A grain formation was executed in the same manner as in the emulsion a, except that 20.7 mg of potassium hexachloroiridate(III) and 0 mg of $Cu(NO_3)_2.2.5\ H_2O$ were contained in the solution B and that 2.3 mg of potassium hexachloroiridate(III) and 14.3 mg of $Cu(NO_3)_2.2.5\ H_2O$ were contained in the solution D. In the emulsion grains having a core:shell ratio=50:50, 90% of potassium hexachloroiridate(III) in an amount of $1\times10^{-4}$ mol/mol.Ag was doped in the core portion, while $Cu(NO_3)_2.2.5\ H_2O$ in an amount of $1\times10^{-4}$ mol was doped in the shell portion of the grains. Then pH was adjusted to 3.8 with sulfuric acid at a concentration of 0.5 mol/L. Then the agitation was terminated and precipitation/desalting/rinsing steps were executed. The pH was adjusted to 5.9 with sodium hydroxide at a concentration of 1 mol/L, thereby obtaining a silver halide dispersion having a pAg value of 8.0. Thereafter a chemical ripening was executed as in the emulsion a, thereby preparing a silver halide emulsion 1.

Thus prepared silver halide emulsion included silver iodobromide grains having an average sphere-corresponding diameter of 0.037 μm and a variation coefficient of the sphere-corresponding diameter of 20% and uniformly containing 3.5 mol % iodine. The grain size etc. were determined from the average of 1000 grains, utilizing an electron microscope. The grains had a [100] plane ratio of 80%, as determined by a Kubelka-Munk method.

(Preparation of Silver Halide Emulsions 2 to 7 of the Invention)

Silver halide emulsions 2 to 7 were prepared in a similar manner as in the silver halide emulsion 1, to give each ratios for each portion of the grain shown in Table 1, by adjusting the addition amount of iridium complex and copper complex or iron comples. The total amount of addition of these metal complexes was maintained constant. Also $K_4Fe(CN)_6$ was used in the case of iron ion doping.

TABLE 1

| | core | | | shell | | | |
|---|---|---|---|---|---|---|---|
| | core ratio (%) | Ir ratio (%) | metal other than Ir | shell ratio (%) | Ir ratio (%) | metal other than Ir | remarks |
| Comp. silver halide-a | 50 | 50 | Cu(50%) | 50 | 50 | Cu(50%) | comp. ex. |
| Comp. silver halide-b | 25 | 0 | — | 75 | 100 | Cu(100%) | comp. ex. |

TABLE 1-continued

| | core | | | shell | | | |
|---|---|---|---|---|---|---|---|
| | core ratio (%) | Ir ratio (%) | metal other than Ir | shell ratio (%) | Ir ratio (%) | metal other than Ir | remarks |
| Silver halide-1 of present invention | 50 | 90 | — | 50 | 10 | Cu(100%) | Present invention |
| Silver halide-2 of present invention | 50 | 100 | — | 50 | — | Cu(100%) | Present invention |
| Silver halide-3 of resent invention | 50 | 90 | Cu(50%) | 50 | 10 | Cu(50%) | Present invention |
| Silver halide-4 of present invention | 50 | 100 | Cu(50%) | 50 | — | Cu(50%) | Present invention |
| Silver halide-5 of present invention | 50 | 90 | Fe(50%) | 50 | 10 | Fe(50%) | Present invention |
| Silver halide-6 of present invention | 50 | 100 | Fe(50%) | 50 | — | Fe(50%) | Present invention |
| Silver halide-7 of present invention | 30 | 90 | Fe(30%) | 70 | 10 | Fe(70%) | Present invention |

(Preparation of Emulsionfor Coating Solution)

1 kg of each of the obtained silver halide emulsions was dissolved, and benzothiazolium iodide in a 1 mass % aqueous solution was added in an amount of $7\times10^{-3}$ mol per 1 mol of silver. Then water was added so as to obtain a silver halide content corresponding to 38.2 g of silver per 1 kg of mixed emulsion for the coating solution, and sodium salt of 1-(3-methylureide)-5-mercaptotetrazole was added in an amount of 0.34 g per 1 kg of the emulsion for the coating solution.

In this manner there were prepared emulsions a, b, and 1-7 for the coating solutions.

2) Preparation of Organic Silver Salt (Preparation of a Fatty Acid Silver Salt Dispersion A)

87.6 kg of behenic acid (manufactured by Henckel Co., trade name Edenor C22-85R), 423 L of distilled water, 49.2 L of a 5 mol/L aqueous solution of NaOH, and 120 L of t-butyl alcohol were mixed and reacted under agitation for 1 hour at 75° C. to obtain a sodium behenate solution A. Separately, 206.2 L of an aqueous solution (pH 4.0) of 40.4 kg of silver nitrate were prepared and maintained at 10° C. A reaction vessel containing 635 L of distilled water and 30 L of t-butyl alcohol was maintained at 30° C., and the entire amount of the sodium behenate solution A and the entire amount of the silver nitrate solution were added under sufficient agitation with constant flow rates, over 93 minutes and 15 seconds and over 90 minutes, respectively. In this operation, during 11 minutes from the start of the addition of the silver nitrate solution, the silver nitrate solution alone was added, then the addition of the sodium behenate solution A was started, and, during 14 minutes and 15 seconds after the completion of addition of the silver nitrate solution, the sodium behenate solution A alone was added. In this operation, the temperature in the reaction vessel was maintained at 30° C., and the external temperature was so controlled as to maintain a constant liquid temperature. Also a piping for adding the sodium behenate solution A was temperature controlled by circulating warm water in an outer jacket of double tubes, thereby adjusting the liquid temperature at an exit end of the addition nozzle at 75° C. Also a piping for adding the silver nitrate solution was temperature controlled by circulating cold water in an outer jacket of double tubes. A position of addition of the sodium behenate solution A and a position of addition of the silver nitrate solution were symmetrically positioned with respect to an agitating shaft, and were adjusted at such a height not touching the reaction liquid.

After the completion of addition of the sodium behenate solution A, the reaction liquid was let to stand for 20 minutes at a same temperature and under agitation, then heated to 35° C. taking 30 minutes, and was thereafter ripened for 210 minutes. Immediately after the completion of the ripening, solid was separated by a centrifugal filtration and was washed with water until the conductivity of filtered water reached 30 μS/cm. A fatty acid silver salt was obtained in this manner. The obtained solid was not dried but stored as a wet cake.

A shape of the obtained silver behanate grains was evaluated by electron microscope. There were identified scale-shaped crystals with average values a=0.14 μm, b=0.4 μm and c=0.6 μm, an average aspect ratio of 5.2, an average sphere-corresponding diameter of 0.52 μm and a variation coefficient of the sphere-corresponding diameter of 15% (a, b and c being defined in the present specification).

To the wet cake corresponding to 260 kg of dry solid, 19.3 kg of polyvinyl alcohol (trade name: PVA-217) and water were added to give a total amount of 1000 kg, then the mixture was made slurry by a dissolver blade and further pre-dispersed by a pipeline mixer (model PM-10; manufactured by Mizuho Kogyo Co.).

Then the pre-dispersed liquid was treated three times in a disperser (trade name: Microfluidizer M-610, manufactured by Microfluidics International Corporation; with a Z-type interaction chamber) with a pressure adjusted to 1260 kg/cm$^2$, thereby obtaining a silver behenate dispersion. A dispersion temperature of 18° C. was obtained by mounting spiral-piped heat exchangers in front of and behind the interaction chamber and regulating the temperature of a coolant.

(Preparation of a Fatty Acid Silver Salt Dispersion B)

<Preparation of Recrystallized Behenic Acid>

100 kg of behenic acid (manufactured by Henckel Co., trade name Edenor C22-85R) was mixed with 1200 kg of isopropyl alcohol, dissolved therein at 50° C., then filtered with a filter of 10 μm, and recrystallized by cooling to 30° C. A cooling rate at the recrystallization was controlled at 3° C./hr. Obtained crystals were separated by centrifugation, then washed by pouring 100 kg of isopropyl alcohol, and dried. Obtained crystals were esterified and were identified, by a GC-FID measurement, to contain 96 mass % of behenic acid, 2 mass % of lignoceric acid, 2 mass % of arachidic acid and 0.001 mass % of erucic acid.

<Preparation of a Fatty Acid Silver Salt Dispersion B>

88 kg of recrystallized behenic acid, 422 L of distilled water, 49.2 L of a 5 mol/L aqueous solution of NaOH, and 120 L of t-butyl alcohol were mixed and reacted under agitation for 1 hour at 75° C. to obtain a sodium behenate solution B. Separately, 206.2 L of an aqueous solution (pH 4.0) of 40.4 kg of silver nitrate was prepared and maintained at 10° C. A reaction vessel containing 635 L of distilled water and 30 L of t-butyl alcohol was maintained at 30° C., and the entire amount of the sodium behenate solution B and the entire amount of the silver nitrate solution were added under sufficient agitation with constant flow rates, over 93 minutes and 15 seconds and over 90 minutes, respectively. In this operation, during 11 minutes from the start of the addition of the silver nitrate solution, the silver nitrate solution alone was added, then the addition of the sodium behenate solution B was started, and, during 14 minutes and 15 seconds after the completion of addition of the silver nitrate solution, the sodium behenate solution B alone was added. In this operation, the temperature in the reaction vessel was maintained at 30° C., and the external temperature was so controlled as to maintain a constant liquid temperature. Also a piping for adding the sodium behenate solution B was temperature controlled by circulating warm water in an outer jacket of double tubes, thereby adjusting the liquid temperature at an exit end of the addition nozzle at 75° C. Also a piping for adding the silver nitrate solution was temperature controlled by circulating cold water in an outer jacket of double tubes. A position of addition of the sodium behenate solution B and a position of addition of the silver nitrate solution were symmetrically positioned with respect to an agitating shaft, and were adjusted at such a height not touching the reaction liquid.

After the completion of addition of the sodium behenate solution B, the reaction liquid was let to stand for 20 minutes at a same temperature and under agitation, then heated to 35° C. over 30 minutes, and was thereafter ripened for 210 minutes. Immediately after the completion of the ripening, solid was separated by a centrifugal filtration and was washed with water until the conductivity of filtered water reached 30 μS/cm. A fatty acid silver salt was obtained in this manner. The obtained solid was not dried but stored as a wet cake.

A shape of the obtained silver behanate grains was evaluated by electron microscope. There were identified crystals with average values a=0.21 μm, b=0.4 μm and c=0.4 μm, an average aspect ratio of 2.1, and a variation coefficient of the sphere-corresponding diameter of 11% (a, b and c being defined in the present specification).

To the wet cake corresponding to 260 kg of dry solid, 19.3 kg of polyvinyl alcohol (trade name: PVA-217) and water were added to give a total amount of 1000 kg, then the mixture was made slurry by a dissolver blade and further pre-dispersed by a pipeline mixer (model PM-10; manufactured by Mizuho Kogyo Co.).

Then the pre-dispersed liquid was treated three times in a disperser (trade name: Microfluidizer M-610, manufactured by Microfluidics International Corporation; with a Z-type interaction chamber) with a pressure adjusted to 1150 kg/cm$^2$, thereby obtaining a silver behenate dispersion B. A dispersion temperature of 18° C. was obtained by mounting spiral-piped heat exchangers in front of and behind the interaction chamber and regulating the temperature of a coolant.

3) Preparation of Reducing Agent Dispersion (Preparation of Reducing Agent Complex-1 Dispersion)

10 kg of a reducing agent complex-1, 0.12 kg of triphenylphosphine oxide, 16 kg of a 10 mass % aqueous solution of modified polyvinyl alcohol (Kuraray Co.; Poval MP203), and 10 kg of water were added and mixed well to obtain a slurry. The slurry was fed by a diaphragm pump, then dispersed for 4 hours and 30 minutes in a horizontal sand mill (UVM-2; manufactured by Imex Co.) charged with zirconia beads having an average diameter of 0.5 mm, and 0.2 g of sodium benzoisothiazolinone and water were added to obtain a concentration of the reducing agent complex of 22 mass %, whereby a reducing agent complex-1 dispersion was obtained. The reducing agent complex particles contained in thus obtained reducing agent complex dispersion had a median diameter of 0.45 μm and a maximum particle size of 1.4 μm or less. The obtained reducing agent complex dispersion was stored after a filtration with a polypropylene filter having a pore size of 3.0 μm, for removing foreign substances such as dusts.

(Preparation of Reducing Agent-2 Dispersion)

10 kg of a reducing agent-2, 16 kg of a 10 mass % aqueous solution of modified polyvinyl alcohol (Kuraray Co.; Poval MP203), and 10 kg of water were added and mixed well to obtain a slurry. The slurry was fed by a diaphragm pump, then dispersed for 3 hours and 30 minutes in a horizontal sand mill (UVM-2; manufactured by Imex Co.) charged with zirconia beads having an average diameter of 0.5 mm, and 0.2 g of sodium benzoisothiazolinone and water were added to obtain a concentration of the reducing agent of 25 mass %. The liquid dispersion was heated for 5 hours at 60° C. to obtain a reducing agent-2 dispersion. The reducing agent particles contained in thus obtained reducing agent dispersion had a median diameter of 0.40 μm and a maximum particle size of 1.5 μm or less. The obtained reducing agent dispersion was stored after a filtration with a polypropylene filter having a pore size of 3.0 μm, for removing foreign substances such as dusts.

4) Preparation of Hydrogen Bonding Compound-1 Dispersion 10 kg of a hydrogen bonding compound-1, 16 kg of a 10 mass % aqueous solution of modified polyvinyl alcohol (Kuraray Co.; Poval MP203), and 10 kg of water were added and mixed well to obtain a slurry. The slurry was fed by a diaphragm pump, then dispersed for 3 hours and 30 minutes in a horizontal sand mill (UVM-2; manufactured by Imex Co.) charged with zirconia beads having an average diameter of 0.5 mm, and 0.2 g of sodium benzoisothiazolinone and water were added to obtain a concentration of the hydrogen bonding compound of 25 mass %. The liquid dispersion was heated for 1 hour at 80° C. to obtain a hydrogen bonding compound-1 dispersion. The hydrogen bonding compound particles contained in thus obtained hydrogen bonding compound dispersion had a median diameter of 0.35 μm and a maximum particle size of 1.5 μm or less. The obtained hydrogen bonding compound dispersion was stored after a filtration with a polypropylene filter having a pore size of 3.0 μm, for removing foreign substances such as dusts.

5) Preparation of Development Accelerator-1 Dispersion 10 kg of a development accelerator-1, 20 kg of a 10 mass % aqueous solution of modified polyvinyl alcohol (Kuraray Co.; Poval MP203), and 10 kg of water were added and mixed well to obtain a slurry. The slurry was fed by a diaphragm pump, then dispersed for 3 hours and 30 minutes in a horizontal sand mill (UVM-2; manufactured by Imex Co.) charged with zirconia beads having an average diameter of 0.5 mm, and 0.2 g of sodium benzoisothiazolinone and water were added to obtain a concentration of the development accelerator of 20 mass % thereby obtaining a development accelerator-1 dispersion. The development accelerator particles contained in thus obtained development accelerator dispersion had a median diameter of 0.48 μm and a maximum particle size of 1.4 μm or less. The obtained development accelerator dispersion was stored after a filtration with a polypropylene filter having a pore size of 3.0 μm, for removing foreign substances such as dusts.

Solid dispersions of a development accelerator-2 and a color controlling agent-1 were also dispersed by a process similar to that for the development accelerator-1, thereby obtaining 20 mass % dispersions.

6) Preparation of Polyhalogen Compound Dispersion (Preparation of Organic Polyhalogen Compound-1 Dispersion)

10 kg of an organic polyhalogen compound-1, 10 kg of a 20 mass % aqueous solution of modified polyvinyl alcohol (Kuraray Co.; Poval MP203), and 14 kg of water were added and mixed well to obtain a slurry. The slurry was fed by a diaphragm pump, then dispersed for 5 hours in a horizontal sand mill (UVM-2; manufactured by Imex Co.) charged with zirconia beads having an average diameter of 0.5 mm, and 0.2 g of sodium benzoisothiazolinone and water were added to obtain a concentration of the organic polyhalogen compound of 26 mass % thereby obtaining an organic polyhalogen compound-1 dispersion. The organic polyhalogen compound particles contained in thus obtained polyhalogen compound dispersion had a median diameter of 0.41 μm and a maximum particle size of 2.0 μm or less. The obtained organic polyhalogen compound dispersion was stored after a filtration with a polypropylene filter having a pore size of 3 μm, for removing foreign substances such as dusts.

(Preparation of Organic Polyhalogen Compound-2 Dispersion) 10 kg of an organic polyhalogen compound-2, 20 kg of a 10 mass % aqueous solution of modified polyvinyl alcohol (Kuraray Co.; Poval MP203) were added and mixed well to obtain a slurry. The slurry was fed by a diaphragm pump, then dispersed for 5 hours in a horizontal sand mill (UVM-2; manufactured by Imex Co.) charged with zirconia beads having an average diameter of 0.5 mm, and 0.2 g of sodium benzoisothiazolinone and water were added to obtain a concentration of the organic polyhalogen compound of 30 mass %. The liquid dispersion was heated for 5 hours at 40° C. to obtain an organic polyhalogen compound-2 dispersion. The organic polyhalogen compound particles contained in thus obtained organic polyhalogen compound dispersion had a median diameter of 0.40 μm and a maximum particle size of 1.3 μm or less. The obtained organic polyhalogen compound dispersion was stored after a filtration with a polypropylene filter having a pore size of 3.0 μm, for removing foreign substances such as dusts.

7) Preparation of Phthalazine Compound-1 Solution 8 kg of modified polyvinyl alcohol (MP203, manufactured by Kuraray Co.) was dissolved in 174.57 kg of water, and 3.15 kg of a 20 mass % aqueous solution of sodium triisopropylnaphthalenesulfonate and 14.28 kg of a 70 mass % aqueous solution of a phthalazine compound-1 (6-isopropylphthalazine) were added to obtain a 5 mass % solution of the phthalazine compound-1.

8) Preparation of Mercapto Compound (Preparation of Aqueous Solution of Mercapto Compound-1)

7 g of a mercapto compound-1 was dissolved in 993 g of water to obtain a 0.7 mass % aqueous solution.

(Preparation of Aqueous Solution of Mercapto Compound-2)

20 g of a mercapto compound-2 was dissolved in 980 g of water to obtain a 2.0 mass % aqueous solution.

9) Preparation of Pigment-1 Dispersion 64 g of C.I. Pigment Blue 60, 6.4 g of Demol N (Kao Ltd.) and 250 g of water were added and mixed well to obtain a slurry. The slurry was placed in a vessel together with 800 of zirconia beads having an average diameter of 0.5 mm, then dispersed for 25 hours in a disperser (1/4G sand grinder mill, manufactured by Imex Co.) and water was added to obtain a concentration of the pigment of 5 mass %, thereby obtaining a pigment-1 dispersion. The pigment particles contained in thus obtained pigment dispersion had an average particle size of 0.21 μm.

10) Preparation of SBR Latex

An SBR latex was prepared in a following manner.

287 g of distilled water, 7.73 g of a surfactant (Pionin A-43-S (Takemoto Yushi Co.); solid content 48.5%), 14.06 ml of a 1 mol/L solution of NaOH, 0.15 g of tetrasodium ethylenediamine tetraacetate, 255 g of styrene, 11.25 g of acrylic acid, and 3.0 g of tert-dodecylmercaptane were charged in a reactor of a gas monomer reacting apparatus (TAS-2J; manufactured by Taiatsu Glass Industries Co.), then the reactor was closed and the mixture was agitated at a rotation rate of 200 rpm. After repeating degassing by a vacuum pump and replacement with nitrogen several times, 108.75 g of 1,3-butadiene was pressed in and an internal temperature was elevated to 60° C. Then a solution obtained by dissolving 1.875 g of ammonium persulfate in 50 ml of water was added and the agitation was continued for 5 hours. Then the temperature was raised to 90° C. and the agitation was continued for 3 hours. After the reaction, when the internal temperature was lowered to the room temperature, NaOH and $NH_4OH$ at a concentration of 1 mol/L were added to obtain $Na^+$ ion:$NH_4^+$ ion=1:5.3 (molar ratio) and a pH 8.4. Then a filtration was executed with a polypropylene filter having a pore size of 1.0 μm for removing foreign substances such as dusts, thereby obtaining 774.7 g of an SBR latex. A halogen ion measurement by ion chromatography proved a chloride ion concentration of 3 ppm. Also a measurement with high-speed liquid chromatography proved a chelating agent concentration of 145 ppm.

The aforementioned latex had an average particle size of 90 nm, a Tg of 17° C., a solid concentration of 44 mass %, an equilibrated moisture content at 25° C. and 60% RH of 0.6 mass %, an ion conductivity of 4.80 mS/cm (measured with a conductometer CM-30S manufactured by Toa Dempa Kogyo Co., on the latex (44 mass %) at 25° C.), and pH 8.4.

3-2. Preparation of Coating Solution

1) Coating Solution for Image Forming Layer (Preparation of Coating Solutions—a, b, and 1 to 7 for Image Forming Layers)

1000 g of the aforementioned fatty acid silver salt dispersion A, 276 ml of water, 33 g of the pigment-1 dispersion, 21 g of the organic polyhalogen compound-1 dispersion, 58 g of the organic polyhalogen compound-2 dispersion, 173 g of the phthalazine compound-1 solution, 1082 g of the SBR latex solution (Tg: 17° C.), 299 g of the reducing agent complex-1 dispersion, 5.7 g of the development accelerator-1 dispersion, 9 ml of the mercapto compound-1 aqueous solution, and 27 ml of the mercapto compound-2 aqueous solution were added in succession, and 117 g of one of the emulsions—a, b, and 1 to 7 for the coating solution was added and mixed well immediately before the coating, and thus obtained coating solution for the emulsion layer was directly fed to a coating die and coated.

2) Preparation of an Intermediate Layer Coating Solution 1000 g of polyvinyl alcohol PVA-205 (manufactured by Kuraray Co.), 272 g of a pigment-1 dispersion, 4200 ml of a 19 mass % latex of methyl methacrylate/styrene/butyl acrylate/hydroxyethyl methacrylate/acrylic acid copolymer (copolymerizing weight ratio: 64/9/20/5/2), 27 ml of a 5 mass % aqueous solution of Aerosol OT (manufactured by American Cyanamide Inc.), 135 ml of a 20 mass % aqueous solution of diammonium phthalate, and water to make a total amount of 10000 g were mixed and the pH was adjusted to 7.5 with NaOH to obtain an intermediate layer coating solution, which was supplied to a coating die with a rate of 9.1 ml/m$^2$.

The coating solution had a viscosity of 58 [mPa·s] in a measurement with a Brookfield viscosimeter (rotor No. 1, 60 rpm) at 40° C.

3) Preparation of Coating Solution for First Emulsion-surface Protective Layer 64 g of inert gelatin was dissolved in water, then 112 g of a 19 mass % latex of methyl methacrylate/styrene/butyl acrylate/hydroxyethyl methacrylate/acrylic acid copolymer (copolymerizing weight ratio: 64/9/20/5/2), 30 ml of a 15 mass % methanol solution of phthalic acid, 23 ml of a 10 mass % aqueous solution of 4-methylphthalic acid, 28 ml of sulfuric acid at a concentration of 0.5 mol/L, 5 ml of a 5 mass % aqueous solution of Aerosol OT (manufactured by American Cyanamide Inc.), 0.5 g of phenoxyethanol and 0.1 g of benzoisothiazolinone were added and water was added to make a total amount of 750 g, thereby obtaining a coating solution, which, after addition of 26 ml of a 4 mass % solution of chromium alum by a static mixer immediately before coating, was supplied to a coating die with a rate of 18.6 ml/m$^2$.

The coating solution had a viscosity of 20 [mPa·s] in a measurement with a Brookfield viscosimeter (rotor No. 1, 60 rpm) at 40° C.

4) Preparation of Coating Solution for Second Emulsion-surface Protective Layer 80 g of inert gelatin was dissolved in water, then 102 g of a 27.5 mass % latex of methyl methacrylate/styrene/butyl acrylate/hydroxyethyl methacrylate/acrylic acid copolymer (copolymerizing weight ratio: 64/9/20/5/2), 5.4 ml of a 2 mass % solution of a fluorine type surfactant (F-1), 5.4 ml of a 2 mass % solution of a fluorine type surfactant (F-2), 23 ml of a 5 mass % solution of Aerosol OT (manufactured by American Cyanamide Inc.), 4 g of polymethyl methacrylate fine particles (average particle size 0.7 μm), 21 g of polymethyl methacrylate fine particles (average particle size 4.5 μm), 1.6 g of 4-methylphthalic acid, 4.8 g of phthalic acid, 44 ml of sulfuric acid at a concentration of 0.5 mol/L, 10 mg of benzoisothiazolinone and water to make a total amount of 650 g were added. Then 445 ml of an aqueous solution containing 4 mass % of chromium alum and 0.67 mass % of phthalic acid were mixed with a static mixer immediately before coating, to obtain a coating solution for the surface protective layer, which was supplied to a coating die with a rate of 8.3 ml/m$^2$.

The coating solution had a viscosity of 19 [mPa·s] in a measurement with a Brookfield viscosimeter (rotor No. 1, 60 rpm) at 40° C.

4. Preparation of Coated Samples 4-1. Preparation of Thermal-development Photosensitive Materials 1-a, 1-b, 1-1 to 1-7

Samples 1-a, 1-b, and 1 to 7 of the photothermographic material were prepared by simultaneous multi-layer coatings by a slide bead coating method, on a side opposite to the back side, in an order, from the undercoated surface, of each of the image forming layer coating solutions—a, b, and 1 to 7, an intermediate layer, a first surface protective layer, and a second surface protective layer. In this operation, the temperature was controlled at 31° C. for the image forming layer and the intermediate layer, 36° C. for the first surface protective layer and 37° C. for the second surface protective layer.

In the image forming layer, each compound therein had a following coating amount (g/m$^2$):

| | | |
|---|---|---|
| silver behenate A | 5.58 | |
| pigment (C.I. Pigment Blue 60) | 0.036 | |
| polyhalogen compound-1 | 0.12 | |
| polyhalogen compound-2 | 0.37 | |
| phthalazine compound-1 | 0.19 | |
| SBR latex | | 9.98 |
| reducing agent complex-1 | | 1.41 |
| development accelerator-1 | | 0.025 |
| mercapto compound-1 | | 0.002 |
| mercapto compound-2 | | 0.012 |
| silver halide (as silver amount) | 0.091 | |

Coating and drying conditions were as follows.

The coating was executed at a rate of 160 m/min, with a gap between a front end of a coating die and the substrate maintained within 0.10 to 0.30 mm, and with a pressure in a reduced-pressure chamber maintained lower than the atmospheric pressure by 196 to 882 Pa. The substrate was subjected to a static elimination by an ionized air flow before coating.

The coating solutions were cooled in a succeeding chilling zone with an air flow having a dry bulb temperature of 10 to 20° C., then transported in a non-contact manner and dried by a non-contact spiral drying apparatus with a drying air flow having a dry bulb temperature of 23 to 45° C. and a wet bulb temperature of 15 to 21° C.

After drying, a humidity adjustment was executed at a temperature of 25° C. and in a humidity of 40 to 60% RH, and the film surface was heated to 70 to 90° C. After the heating, the film surface was cooled to 25° C.

In the following, there are shown chemical structures of compounds employed in the examples of the invention.

Spectral sensitizing dye A

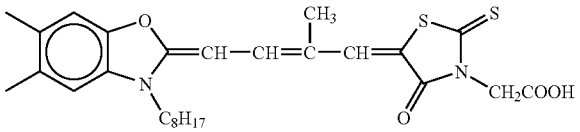

Spectral sensitizing dye B

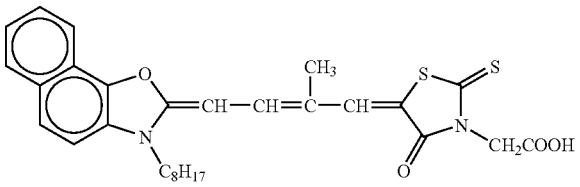

Tellurium sensitizer C

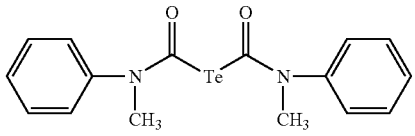

-continued
Base precursor compound 1
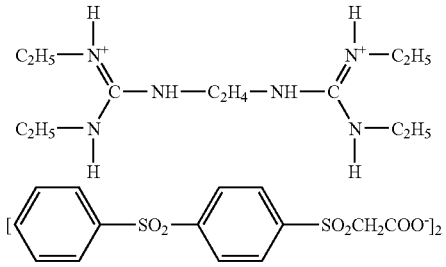
Cyanine dye compound-1
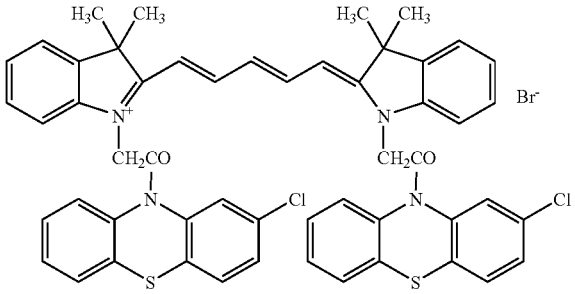
Blue dye compound-1
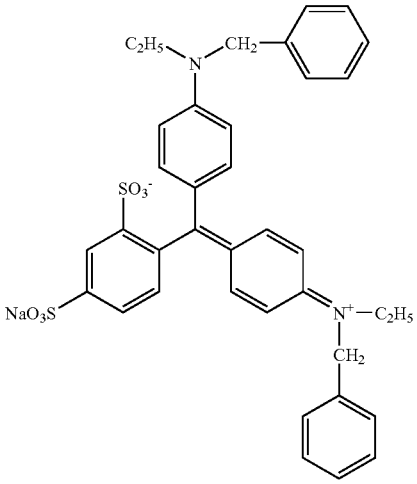
Yellow dye compound-1
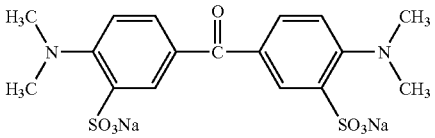
Reducing agent complex-1
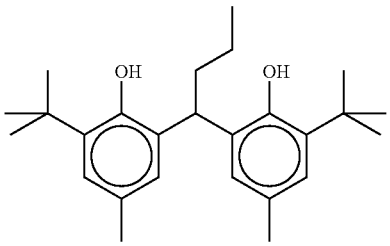
and
-continued
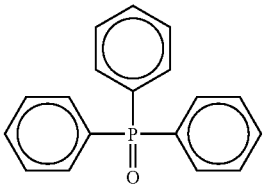
1:1 complex of
Reducing agent-2
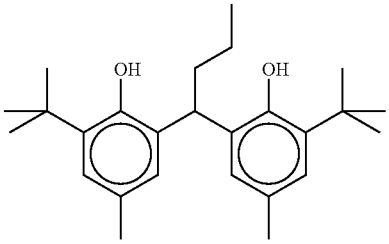
Hydrogen bonding compound-1
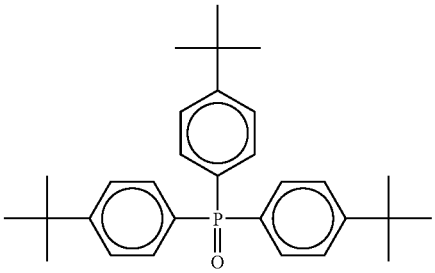
Polyhalogen compound-1
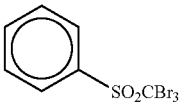
Polyhalogen compound-2
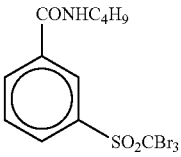
Mercapto compound-1
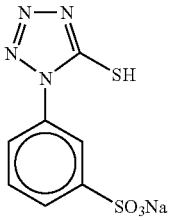
Mercapto compound-2
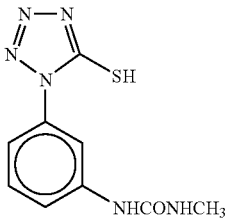

-continued

Phthalazine compound-1

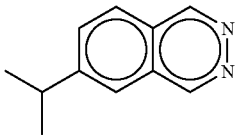

Development accelerator-1

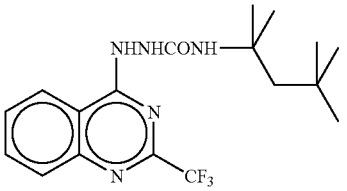

Development accelerator-2

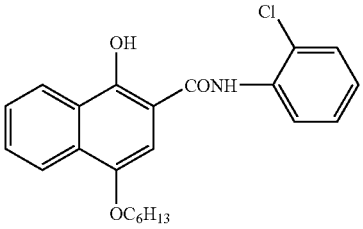

Color controlling agent-1

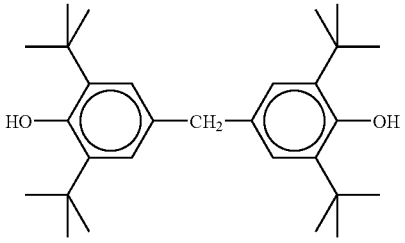

$CF_3(CF_2)_nCH_2CH_2S\ CH_2CH_2COOL\ i$ (F-1)

Mixture of those in which n=5 to 11

$CF_3(CF_2)_nCH_2CH_2O\ (CH_2CH_2O)_mH$ (F-2)

Mixture of those in which n=5 to 11 and m=5 to 15

(F-3)

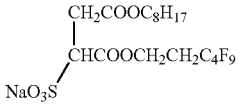

-continued (F-4)

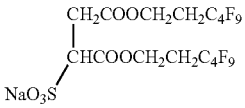

(Evaluation of Photographic Performance)

An obtained sample was cut into a folio size (about 20×12 inch), then packed in a following packaging material in an environment of 25° C. and 50% RH, and, after a storage for 2 weeks at a normal temperature, subjected to following evaluations.

(Packaging Material)

A sheet of PET 10 μm/PE 12 μm/aluminum foil 9 μm/nylon 15 μm/polyethylene 50 μm containing 3 mass % of carbon;

oxygen permeability: 0.02 ml/atm·$m^2$·25° C.·day, moisture permeability: 0.10 g/atm·$m^2$·25° C.·day.

A Fuji Medical Dry Laser Imager FM-DPL (mounted with a 660 nm semiconductor laser with a maximum output of 60 mW(IIIB)) was used for executing exposure and thermal development (24 seconds in total with four heater panels set at 112° C.-119° C.-121° C.-121° C.).

(Density Measurement and Characteristic Values)

An optical density of an obtained image was measured with a Macbeth densitometer, and a characteristic curve indicating the relationship between the exposure amount and the density was prepared.

Fogging: A density (Dmin) in an unexposed area was taken as a fog level.

Sensitivity: A sensitivity is a reciprocal of an exposure amount required for obtaining a density of the fog level +1.0. The sensitivity is represented by a relative value, taking the sensitivity of the thermal-development material 1 as 100. A larger value indicates a higher sensitivity.

(Image Preservability)

A thermally developed sample was let to stand for 30 days in an environment of 25° C., 60% RH and under an irradiation of 200 lux with a fluorescent lamp, and the image preservability was evaluated by a difference in the fog level between immediately after thermal development and after standing. In a photothermographic material, the fog level increases with passage of standing time, in the case of a sample with an inferior image preservability. Therefore a smaller increase in the fog level is desirable:

ΔDmin=Dmin (after standing)−Dmin (immediately after thermal development)

Obtained results are shown in Table 2. The samples of the present invention showed satisfactory results with a high sensitivity, a low fog level, and a less printout. In particular, an improvement in the printout is a result completely unexpected from the prior knowledge.

TABLE 2

| Sample No. | Silver halide emulsion | Dmin | Sensitivity | Printout | Remarks |
|---|---|---|---|---|---|
| 1-a | comparative silver halide-a | 0.18 | 100 | 0.1 | comp. ex. |
| 1-b | comparative silver halide-b | 0.17 | 103 | 0.08 | comp. ex. |
| 1-1 | silver halide-1 of Present invention | 0.16 | 104 | 0.05 | Present invention |
| 1-2 | silver halide-2 of Present invention | 0.16 | 105 | 0.04 | Present invention |

TABLE 2-continued

| Sample No. | Silver halide emulsion | Dmin | Sensitivity | Printout | Remarks |
|---|---|---|---|---|---|
| 1-3 | silver halide-3 of Present invention | 0.16 | 103 | 0.05 | Present invention |
| 1-4 | silver halide-4 of Present invention | 0.16 | 102 | 0.04 | Present invention |
| 1-5 | silver halide-5 of Present invention | 0.16 | 104 | 0.06 | Present invention |
| 1-6 | silver halide-6 of Present invention | 0.16 | 104 | 0.04 | Present invention |
| 1-7 | silver halide-7 of Present invention | 0.16 | 103 | 0.03 | Present invention |

Example 2

(Preparation of Coating Solutions-2a, 2b, and 21 to 27 for Image Forming Layers)

1000 g of the aforementioned fatty acid silver salt dispersion B, 276 ml of water, 35 g of the pigment-1 dispersion, 32 g of the organic polyhalogen compound-1 dispersion, 46 g of the organic polyhalogen compound-2 dispersion, 173 g of the phthalazine compound-1 solution, 1082 g of the SBR latex solution (Tg: 17° C.), 153 g of the reducing agent-2 dispersion, 55 g of the hydrogen bonding compound-1 dispersion, 4.8 g of the development accelerator-1 dispersion, 5.2 g of the development accelerator-2 dispersion, 2.1 g of the color controlling agent-1 dispersion, and 8 ml of the mercapto compound-2 aqueous solution were added in succession, and 140 g of one of the emulsions-a, b, and 1 to 7 for the coating solution were added and mixed well immediately before the coating, and thus obtained coating solutions-2a, 2b, and 21 to 27 for the emulsion layer were directly fed to a coating die and coated.

| | |
|---|---|
| silver behenate B | 5.27 |
| pigment (C.I. Pigment Blue 60) | 0.036 |
| polyhalogen compound-1 (shown in Table 1) | 0.17 |
| polyhalogen compound-2 (shown in Table 2) | 0.28 |
| phthalazine compound-1 | 0.18 |
| SBR latex | 9.43 |
| reducing agent −2 (shown in Table 1) | 0.77 |
| hydrogen-bonding compound-1 | 0.28 |
| (shown in Table 1) | 0.28 |
| development accelerator-1 | 0.019 |
| development accelerator-2 | 0.020 |
| color controlling agent-1 | 0.008 |
| mercapto compound-2 | 0.003 |
| silver halide (as silver amount) | 0.091 |

The samples were evaluated in the same manner as in the example 1, except for change of the thermal development time to 14 seconds in total.

Obtained results are shown in Table 3.

TABLE 3

| Sample No. | Silver halide emulsion | Dmin | Sensitivity | Printout | Remarks |
|---|---|---|---|---|---|
| 2-a | comparative silver halide-a | 0.19 | 110 | 0.12 | comp. ex. |
| 2-b | comparative silver halide-b | 0.19 | 109 | 0.11 | comp. ex. |
| 21 | silver halide-1 of invention | 0.18 | 112 | 0.08 | invention |
| 22 | silver halide-2 of invention | 0.17 | 113 | 0.07 | invention |
| 23 | silver halide-3 of invention | 0.18 | 114 | 0.08 | invention |
| 24 | silver halide-4 of invention | 0.17 | 113 | 0.07 | invention |
| 25 | silver halide-5 of invention | 0.18 | 114 | 0.08 | invention |
| 26 | silver halide-6 of invention | 0.17 | 112 | 0.07 | invention |
| 27 | silver halide-7 of invention | 0.16 | 114 | 0.06 | invention |

(Preparation of Photothermographic Materials 2a, 2b, and 21 to 27)

Photothermographic materials 2a, 2b, and 21 to 27 were prepared in a similar manner as in the example 1, except that the image forming layer coating solutions—a, b,—and 1 to 7 were changed to the image forming layer coating solutions—2a, 2b,—and 21 to 27, the yellow dye compound-1 was eliminated from the antihalation layer and the fluorine type surfactants F-1 and F-2 in the back surface protective layer and the surface protective layer were respectively replaced by F-3 and F-4.

In the image forming layer, each compound therein had the following coating amount (g/m$^2$):

The samples of the invention showed satisfactory results with a high sensitivity, a low fog level and a reduced printout. In particular, an improvement in the printout is a result completely unexpected from the prior knowledge.

Example 3

Emulsions 31 to 34 were prepared by replacing $Cu(NO_3)_2.2.5\ H_2O$ as the metal other than Ir in the emulsion 1 of the invention respectively with $K_4[Ru(CN)_6]$, $K_4[Os(CN)_6]$, K4[$PtBr_4$] and $[CoCl_2(Im)_2]$. Also emulsions 35 to 38 were prepared by changing the core-shell ratio of the emulsion 1 of the invention as shown in Table 4. These emulsions were employed in a sample preparation and a performance evaluation under conditions same as those in the example 1 to obtain results shown in Table 5.

As in the example 1, the samples of the invention showed satisfactory results with a high sensitivity, a low fog level and a reduced printout.

TABLE 4

| | core | | | shell | | | |
|---|---|---|---|---|---|---|---|
| | core ratio (%) | Ir ratio (%) | metal other than Ir | shell ratio (%) | Ir ratio (%) | metal other than Ir | remarks |
| Emulsion -31 | 50 | 90 | — | 50 | 10 | Ru(100%) | Present invention |
| Emulsion -32 | 50 | 90 | — | 50 | 10 | Os(100%) | Present invention |
| Emulsion -33 | 50 | 90 | — | 50 | 10 | Pt(100%) | Present invention |
| Emulsion -34 | 50 | 90 | — | 50 | 10 | Co(100%) | Present invention |
| Emulsion -35 | 15 | 90 | — | 85 | 10 | Fe(100%) | Present invention |
| Emulsion -36 | 40 | 90 | — | 60 | 10 | Fe(100%) | Present invention |
| Emulsion -37 | 60 | 90 | — | 40 | 10 | Fe(100%) | comp. ex. |
| Emulsion -38 | 80 | 90 | — | 20 | 10 | Fe(100%) | comp. ex. |

TABLE 5

| Sample No. | Silver halide emulsion | Dmin | Sensitivity | Printout | Remarks |
|---|---|---|---|---|---|
| 31 | Emulsion-31 | 0.19 | 110 | 0.1 | comp. ex. |
| 32 | Emulsion-32 | 0.19 | 109 | 0.09 | comp. ex. |
| 33 | Emulsion-33 | 0.16 | 110 | 0.08 | invention |
| 34 | Emulsion-34 | 0.17 | 112 | 0.08 | invention |
| 35 | Emulsion-35 | 0.18 | 111 | 0.06 | invention |
| 36 | Emulsion-36 | 0.17 | 112 | 0.07 | invention |
| 37 | Emulsion-37 | 0.18 | 112 | 0.11 | invention |
| 38 | Emulsion-38 | 0.17 | 112 | 0.13 | invention |

Example 4

Employing the formulation of the emulsion 1 of the example 1, an emulsion 41 was prepared by a method in which the addition of the Ir salt and the Cu salt was conducted under controlled rates and a controlled electric potential (employing the same method as in the emulsion 1), while a photosensitive silver halide emulsion 42 was prepared by a method in which the entire amount of the Ir salt was added in advance directly into the reaction vessel of the silver halide (such addition being called "rush addition"). Also a photosensitive silver halide emulsion 43 was prepared by adding the entire amounts of the Ir salt and the Cu salts in advance directly into the reaction vessel of the silver halide.

Samples 41 to 43 were prepared with these emulsions under conditions same as those in the example 1 and their performances were evaluated in the same manner as in the example 1. Obtained results are shown in Table 6.

Results of Performance Evaluation

As shown in Table 6, the effect of the metals of the invention was fully exhibited particularly in the case of the rush addition.

TABLE 6

| Sample No. | Silver halide emulsion | Dmin | Sensitivity | Printout | Remarks |
|---|---|---|---|---|---|
| 41 | silver halide-41 of present invention | 0.19 | 110 | 0.06 | Present invention |
| 42 | silver halide-42 of present invention | 0.18 | 112 | 0.05 | Present invention |
| 43 | silver halide-43 of present invention | 0.17 | 114 | 0.04 | Present invention |

The improved photosensitive silver halide emulsion of the invention allows to provide a photothermographic material having a high sensitivity and a low fog level and improved in the printout phenomenon.

What is claimed is:

1. A black-and-white photothermographic material that forms a black-and-white image by a silver image, the black-and-white photothermographic material comprising, on one surface of a substrate, photosensitive silver halide grains having a core/shell structure, a non-photosensitive organic silver salt, a reducing agent and a binder, wherein said photosensitive silver halide grains include at least iridium and a metal selected from the group consisting of iron, copper, rhodium and ruthenium, an amount of iridium in the silver halide grains is from $1\times10^{-8}$ to $1\times10^{-2}$ mol per 1 mol of silver halide, an amount of the metal selected from the group consisting of iron, copper, rhodium and ruthenium in the silver halide grains is from $1\times10^{-8}$ to $1\times10^{-2}$ mol per 1 mol of silver halide, and 90% or more of a total iridium amount contained in the silver halide grains is contained in a core portion of the grain providing that, the core portion of the grain corresponds to 50% of the total mol % of silver halide in the grain, and at least 50% of a total amount of the metal selected from the group consisting of iron, copper, rhodium and ruthenium contained in the silver halide grains is contained in the shell portion of the grain, wherein the reducing agent is a bisphenol compound represented by the following formula (R)

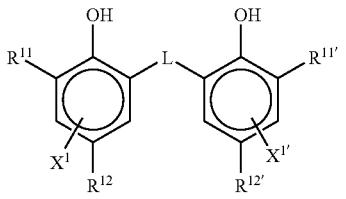

formula (R):

wherein, in formula (R), $R^{11}$ and $R^{11'}$ each independently represents an alkyl group with 1 to 20 carbon atoms; $R^{12}$ and $R^{12'}$ each independently represents a hydrogen atom or a substituent that can substitute the benzene ring; L represents —S— or —$CHR^{13}$—; $R^{13}$ represents a hydrogen atom or an alkyl group with 1 to 20 carbon atoms; and $X^1$ and $X^{1'}$ each independently represents a hydrogen atom or a group that can substitute the benzene ring;

and wherein the silver halide is silver bromide, silver iodobromide or silver iodide.

2. A photothermographic material according to claim 1, wherein said metal selected from the group consisting of iron, copper, rhodium and ruthenium is iron or ruthenium.

3. A photothermographic material according to claim 1, wherein said photosensitive silver halide grains have an average particle size of 10 to 50 nm.

4. A photothermographic material according to claim 1, wherein the photosensitive silver halide grains are chemically sensitized by one of a sulfur sensitizing method, a selenium sensitizing method, and a tellurium sensitizing method.

5. A photothermographic material according to claim 1, wherein the photosensitive silver halide grains are gold sensitized.

6. A photothermographic material according to claim 1, wherein the photosensitive silver halide grains are reduction sensitized.

7. A photothermographic material according to claim 1, further comprising a fragmentable electron donating sensitizer (FED sensitizer).

8. A photothermographic material according to claim 1, wherein the photosensitive silver halide grains have a core/shell structure of two to five layers.

9. A black-and-white photothermographic material that forms a black-and-white image by a silver image, the black-and-white photothermographic material comprising, on one surface of a substrate, photosensitive silver halide grains having a core/shell structure, a non-photosensitive organic silver salt, a reducing agent and a binder, wherein said photosensitive silver halide grains include at least iridium and a metal selected from the group consisting of iron, copper, rhodium and ruthenium, an amount of iridium in the silver halide grains is from $1\times10^{-8}$ to $1\times10^{-2}$ mol per 1 mol of silver halide, an amount of the metal selected from the group consisting of iron, cooper, rhodium and ruthenium in the silver halide grains is from $1\times10^{-8}$ to $1\times10^{-2}$ mol per 1 mol of silver halide, and 90% or more of a total iridium amount contained in the silver halide grains is contained in a core portion of the grain providing that the core portion of the grain corresponds to 30% of the total mol % of silver halide in the grain, and at least 70% of a total amount of the metal selected from the group consisting of iron, copper, rhodium and ruthenium contained in the silver halide grains is contained in the shell portion of the grain, wherein the reducing agent is a bisphenol compound represented by the following formula (R)

formula (R)

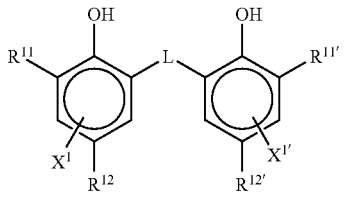

wherein, in formula (R), $R^{11}$ and $R^{11'}$ each independently represents an alkyl group with 1 to 20 carbon atoms; $R^{12}$ and $R^{12'}$ each independently represents a hydrogen atom or a substituent that can substitute the benzene ring; L represents —S— or —$CHR^{13}$—; $R^{13}$ represents a hydrogen atom or an alkyl group with 1 to 20 carbon atoms; and $X^1$ and $X^{1'}$ each independently represents a hydrogen atom or a group that can substitute the benzene ring;

and wherein the silver halide is silver bromide, silver iodobromide or silver iodide.

* * * * *